US010344436B2

(12) United States Patent
Guven

(10) Patent No.: US 10,344,436 B2
(45) Date of Patent: Jul. 9, 2019

(54) MODULAR ACCESS STRUCTURE

(71) Applicant: Tecnik Technologies Pty Limited, North Sydney (AU)

(72) Inventor: Savas Guven, Mosman (AU)

(73) Assignee: TECNIK TECHNOLOGIES PTY LIMITED, North Sydney (AU)

( * ) Notice: Subject to any disclaimer, the term of this patent is extended or adjusted under 35 U.S.C. 154(b) by 0 days.

(21) Appl. No.: 15/701,302

(22) Filed: Sep. 11, 2017

(65) Prior Publication Data

US 2018/0119371 A1 May 3, 2018

(30) Foreign Application Priority Data

Nov. 1, 2016 (AU) ..... 2016253555

(51) Int. Cl.

| | |
|---|---|
| ***E01D 15/12*** | (2006.01) |
| ***E01D 15/133*** | (2006.01) |
| ***E04B 1/343*** | (2006.01) |
| ***E04C 3/00*** | (2006.01) |

(52) U.S. Cl.

CPC ..... *E01D 15/124* (2013.01); *E01D 15/133* (2013.01); *E04B 1/34357* (2013.01); *E04B 1/34384* (2013.01); *E04C 3/005* (2013.01)

(58) Field of Classification Search

CPC . E01D 15/124; E01D 15/133; E04B 1/34357; E04B 1/34384; E04C 3/005

USPC ..... 14/2.4; 52/79.1–79.7

See application file for complete search history.

(56) References Cited

U.S. PATENT DOCUMENTS

| | | | | |
|---|---|---|---|---|
| 1,305,306 A | | 6/1919 | Rasmussen | |
| 3,043,264 A | | 7/1962 | Felhofer et al. | |
| 3,783,573 A | * | 1/1974 | Vaughan | E01D 15/124 14/14 |
| 3,994,036 A | * | 11/1976 | Fisher | E04G 3/30 14/10 |
| 4,017,932 A | * | 4/1977 | Lotto | E01D 15/127 14/2.4 |
| 4,521,932 A | * | 6/1985 | Parramore | E01D 15/124 14/2.5 |

(Continued)

FOREIGN PATENT DOCUMENTS

DE 202005002624 U1 5/2005

*Primary Examiner* — Raymond W Addie

(74) *Attorney, Agent, or Firm* — Patterson + Sheridan, LLP

(57) ABSTRACT

An access module for a modular access structure has a longitudinally and vertically extending first frame and a longitudinally and vertically extending second frame. The second frame laterally opposes the first frame. A deformable lower support structure laterally extends between the first and second frames. The lower support structure includes a deck spanning a longitudinal length of the access module. A deformable upper support structure laterally extends between the first and second frames. The upper support structure is spaced above the deck. The access module is configurable by deformation of the lower and upper support structures between an extended configuration in which the first and second frames are spaced apart a first distance and the deck is generally horizontal and a collapsed configuration in which a distance between the first and second frames is less than the first distance. The access module is adapted to be fastened end to end to a second access module.

14 Claims, 21 Drawing Sheets

(56) References Cited

U.S. PATENT DOCUMENTS

| | | | | | |
|---|---|---|---|---|---|
| 4,635,311 | A * | 1/1987 | Helmke | E01D 15/127 | 14/2.5 |
| 5,103,523 | A * | 4/1992 | Drago | E01D 15/124 | 14/2.4 |
| 5,307,533 | A * | 5/1994 | Parramore | E01D 15/124 | 14/2.4 |
| 5,519,909 | A * | 5/1996 | Fuessinger | E01D 15/133 | 14/2.4 |
| 7,082,637 | B1 * | 8/2006 | Griffin | B65G 69/30 | 14/69.5 |
| 8,176,686 | B2 * | 5/2012 | Santini | E04H 3/28 | 52/66 |
| 8,813,455 | B2 * | 8/2014 | Merrifield | E04C 3/005 | 135/144 |
| 2009/0217600 | A1 * | 9/2009 | De Azambuja | B60P 3/34 | 52/79.5 |
| 2012/0180404 | A1 * | 7/2012 | Scouten | E04B 1/34321 | 52/79.5 |
| 2012/0255256 | A1 * | 10/2012 | Montalto | E04G 21/3209 | 52/650.3 |
| 2012/0291364 | A1 * | 11/2012 | Hovsepian | E04H 1/1205 | 52/79.5 |
| 2013/0340183 | A1 * | 12/2013 | Thomas | E01D 15/124 | 14/2.4 |

* cited by examiner

MODULAR ACCESS STRUCTURE

FIELD

The present invention relates to the field of access structures, such as bridges, overhead protection structures, walkways and the like, and in particular relates to a modular access structure and an access module therefor.

BACKGROUND

Temporary access structures in the form of bridge structures have various applications to provide access for pedestrians, workers, vehicles and the like in various situations and environments, including on construction sites and to provide temporary bridge solutions following failure of, or prior to construction of, more permanent bridge structures.

Currently available temporary bridge structures suffer from various deficiencies, including limited spans, costly installation, limited capacities, costly assembly and disassembly and costly transportation to the installation site.

Other forms of temporary access structures that may suffer from similar deficiencies include overhead protection structures, including hoardings, used to provide protection to pedestrians accessing a sidewalk alongside construction sites, and walkways more generally.

OBJECT OF INVENTION

It is an object of the present invention to substantially overcome or at least ameliorate at least one of the above deficiencies.

SUMMARY OF THE INVENTION

In a first aspect the present invention provides an access module for a modular access structure, said access module comprising:

a longitudinally and vertically extending first frame having a longitudinally extending upper chord and a longitudinally extending lower chord;

a longitudinally and vertically extending second frame having a longitudinally extending upper chord and a longitudinally extending lower chord, said second frame laterally opposing said first frame;

a deformable lower support structure laterally extending between said first and second frames, said lower support structure including a deck spanning a longitudinal length of said access module; and a deformable upper support structure laterally extending between said first and second frames, said upper support structure being spaced above said deck to define an access passage extending along a length of said access module between said deck, said upper support structure and said first and second frames;

wherein said access module is configurable by deformation of said lower and upper support structures between an extended configuration in which said first and second frames are spaced apart a first distance and said deck is generally horizontal and a collapsed configuration in which a distance between said first and second frames is less than said first distance;

further wherein said access module is adapted to be fastened end to end to a second access module to form a modular access structure with an access passage extending along a length of the modular access structure, each of said lower chords being adapted to be fastened end to end to a corresponding lower chord of the second access module to form a single load bearing elongate lower chord assembly.

In a preferred embodiment:

said lower support structure comprises a plurality of longitudinally spaced and laterally extending articulated floor beams;

opposing ends of each said floor beam are pivotally attached to said first frame and said second frame respectively;

each said floor beam comprises a first beam segment and a second beam segment pivotally attached to said first beam segment;

wherein said deck is mounted on said floor beams;

further wherein, for each said floor beam:

when said access module is in said extended configuration, said first and second beam segments extend substantially collinearly; and when said access module is in said collapsed configuration, said first and second beam segments are mutually angularly inclined.

In a preferred embodiment:

said upper support structure comprises a plurality of longitudinally spaced and laterally extending lateral struts;

opposing ends of each said lateral strut are pivotally attached to said first frame and said second frame respectively;

each said lateral strut comprises a first strut segment and a second strut segment pivotally attached to said first strut segment;

further wherein, for each said lateral strut:

when said access module is in said extended configuration, said first and second strut segments extend substantially collinearly; and when said access module is in said collapsed configuration, said first and second strut segments are mutually angularly inclined.

In a preferred embodiment said access module further comprises a plurality of connectors, each of said connectors being adapted to fasten one of said chords of one of said frames end to end to a corresponding chord of a corresponding frame of a second access module.

In a preferred form, said upper and lower chords of each of said first and second frames each comprises a hollow structural section and each said connector comprises a spigot mounted in the hollow of the respective said chord.

In a preferred form, each said spigot is displaceable between a protruding configuration in which said spigot protrudes from an end of the respective said chord and a retracted configuration in which said spigot is retained wholly within said chord.

In a preferred form, said deck comprises a first deck section mounted on said first beam segment of each said floor beam and a second deck section mounted on said second beam segment of each of said floor beams;

wherein, when said access module is in said extended configuration, said first and second deck sections substantially abut.

In a preferred form, each said lateral strut is configured to be fixed when said access module is in said extended configuration by way of a strut locking pin extending laterally through said first and second strut segments.

In a preferred form, each said floor beam is configured to be fixed when said access module is in said extended configuration by way of a beam locking pin extending laterally through said first and second beam segments.

In a preferred form, each of said first and second frames further comprises a plurality of laterally projecting upper stubs mounted to or adjacent said upper chord and a plurality of laterally projecting lower stubs mounted to or adjacent said lower chord, each said upper stub of said first frame opposing a corresponding upper stub of said second frame and each said lower stub of said first frame opposing a corresponding lower stub of said second frame;

further wherein:

each of said lateral struts is pivotally attached to corresponding upper stubs of said first and second frames; and each of said floor beams is pivotally attached to corresponding lower stubs of said first and second frames.

Typically, when said access module is in the collapsed configuration, corresponding upper stubs of said first and second frames engage and corresponding lower stubs of said first and second frames engage; and said corresponding upper stubs and said corresponding lower stubs are configured to lock when engaged to lock said access module in said collapsed configuration.

In a preferred embodiment, said first and second frames each further comprise a pair of corner blocks mounted towards opposing longitudinal ends of said upper chord, said corner blocks being configured to be engaged by twist-locks for lifting said access module.

Typically, said corner blocks are located and configured to allow multiple said access modules to be interconnected side to side.

In one form, said access module further comprises a roofing structure extending between said first and second frames adjacent said upper support structure.

In a preferred form, said access module is sized, and said corner blocks located, such that a plurality of said access modules may be interconnected side to side to form an access module assembly with each of said access modules in the collapsed configuration such that the outer most corner blocks of the access module assembly are spaced to at least substantially match the spacing of corner blocks of an ISO standard cargo container.

In a second aspect the present invention provides a modular access structure comprising a plurality of the access modules of the first aspect fastened end to end.

In one form, said modular access structure is a modular bridge structure.

In another form, said modular structure is a modular overhead protection structure.

In a third aspect, the present invention provides a method of forming a modular access structure, said method comprising:

a) aligning a first access module of the first aspect end to end with a second access module of the first aspect, said first and second access modules being in said extended configuration; and b) fastening said first and second access modules end to end to form a modular access assembly, including fastening each of said lower chords of said first access module end to end with a corresponding lower chord of said second access module.

The method may further comprise:

c) aligning a further access module of the first aspect with an end of said access assembly; and d) fastening said further access module to the end of said access assembly to form an extended access assembly.

The method may further comprise repeating steps c) and d) until a length of said access assembly exceeds a distance to be spanned.

BRIEF DESCRIPTION OF DRAWINGS

Preferred embodiments of the present invention will now be described, by way of example only, with reference to the accompanying drawings wherein.

DESCRIPTION OF EMBODIMENTS

Figure 1:
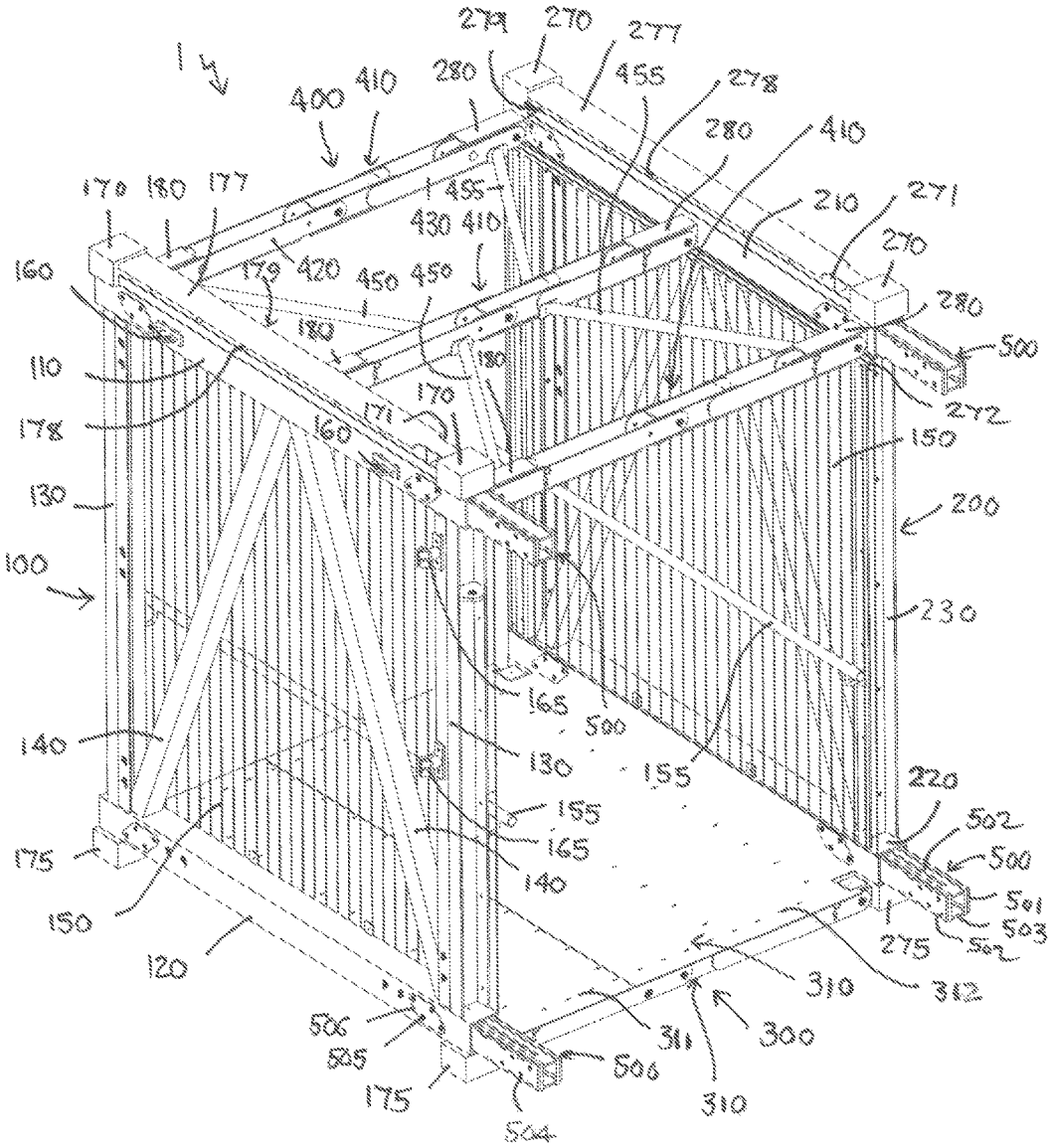
FIG. 1 is an isometric view of an access module.
Figure 2:
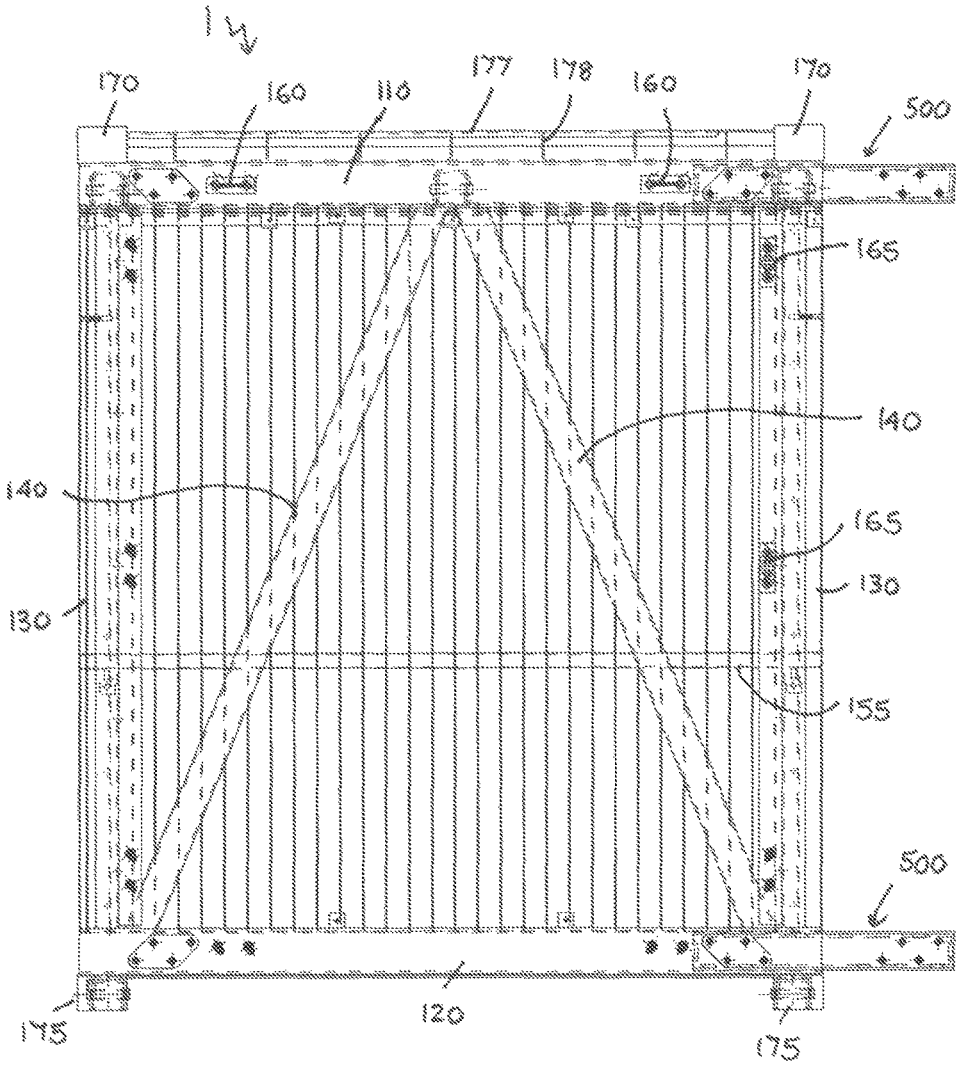
FIG. 2 is a front elevation view of the access module of FIG. 1.

FIGS. 1 to 7 of the accompanying drawings depict an access module 1 for use in the construction of a modular access structure. The access module 1 extends in a longitudinal direction and defines an access passage extending along the length of the access module 1. The access module 1 is adapted to be fastened end to end to a second identical access module which in turn may be fastened end to end to a third access module, and so on, so as to form a modular access structure with a continuous access passage extending along its length, as will be further discussed below.

The access module 1 has a longitudinally and vertically extending first frame 100 and a longitudinally and vertically extending second frame 200. The second frame 200 laterally opposes the first frame 100. The access module 1 further comprises a deformable lower support structure 300 that laterally extends between the first and second frames 100, 200. The lower support structure 300 includes a deck 360 that spans the longitudinal length of the access module 1. A deformable upper support structure 400 is spaced above the deck 360 and laterally extends between the first and second frames 100, 200. In the embodiment depicted, the lower support structure 300 extends between the lower ends of the first and second frames 100, 200 whilst the upper support structure 400 extends between the upper ends of the first and second frames 100, 200. The first and second frames 100, 200 and lower and upper support structures 300, 400 define an access passage extending longitudinally along the length of the access module 1 for the passage of a load, such as pedestrians and/or vehicles, to pass along the deck 360 through the access module 1. The access passage extends uninhibited between the deck 360 and the upper support structure 400 and between the first and second frames 100, 200.

Figure 5:
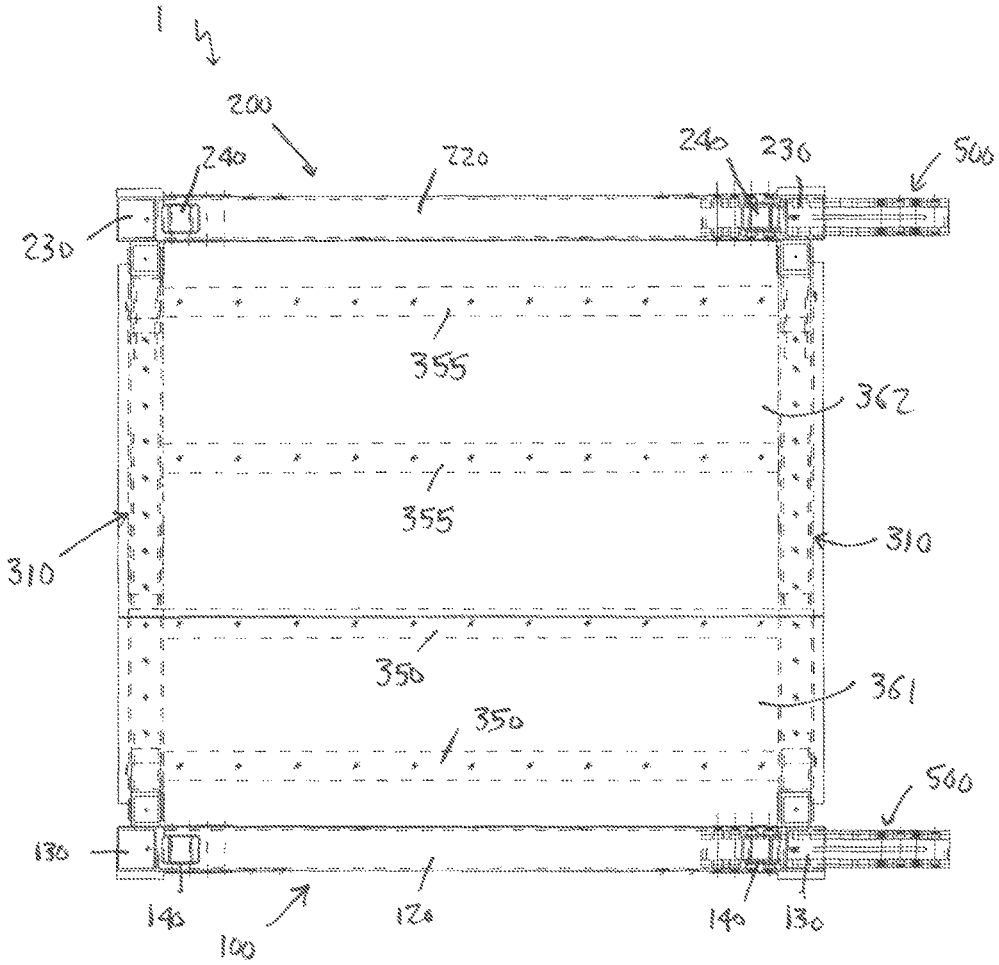
FIG. 5 is a cross-sectional plan view of the access module of FIG. 1 taken at a section above deck level.
Figure 6:
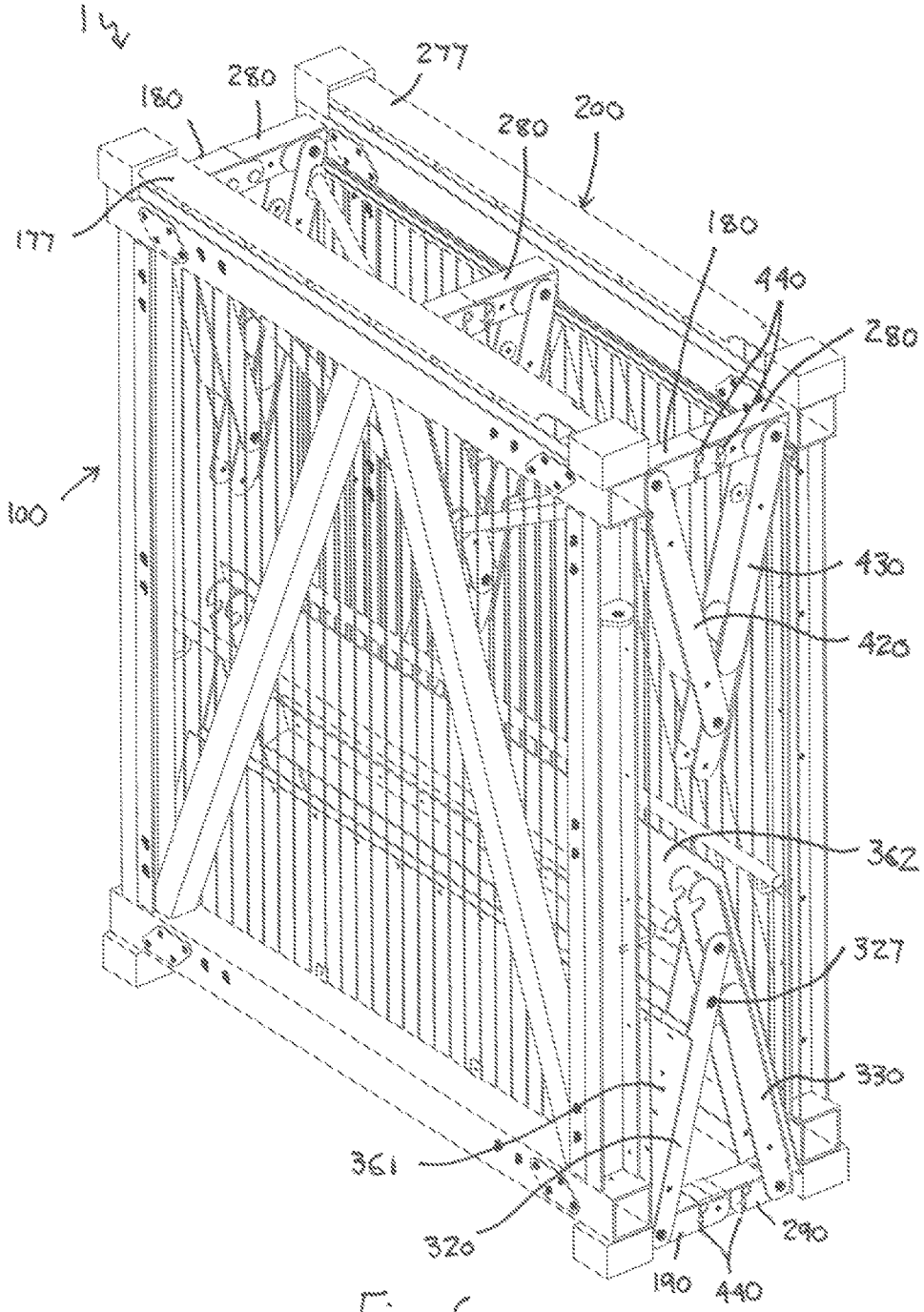
FIG. 6 is an isometric view of the bride module of FIG. 1 in a collapsed configuration.
Figure 7:
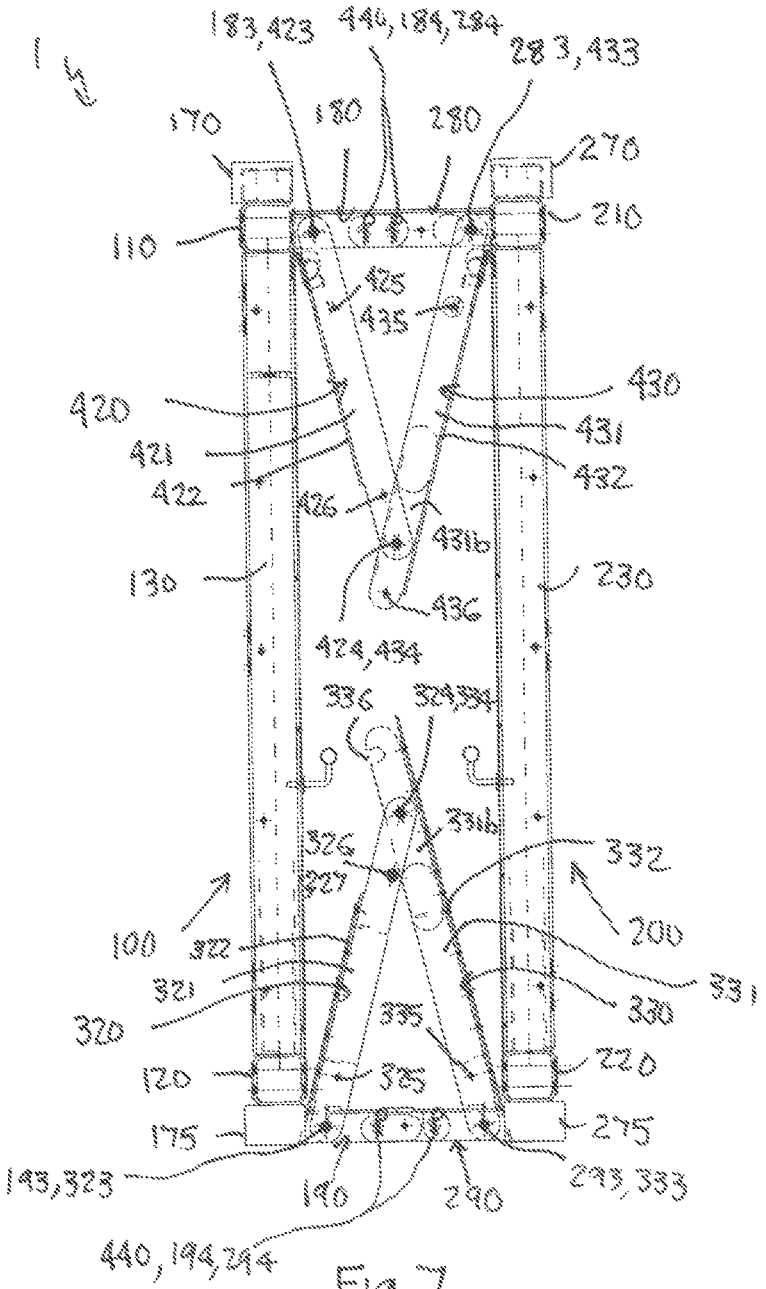
FIG. 7 is an end elevation view of the access module of FIG. 1 in the collapsed configuration of FIG. 6.
Figure 8:
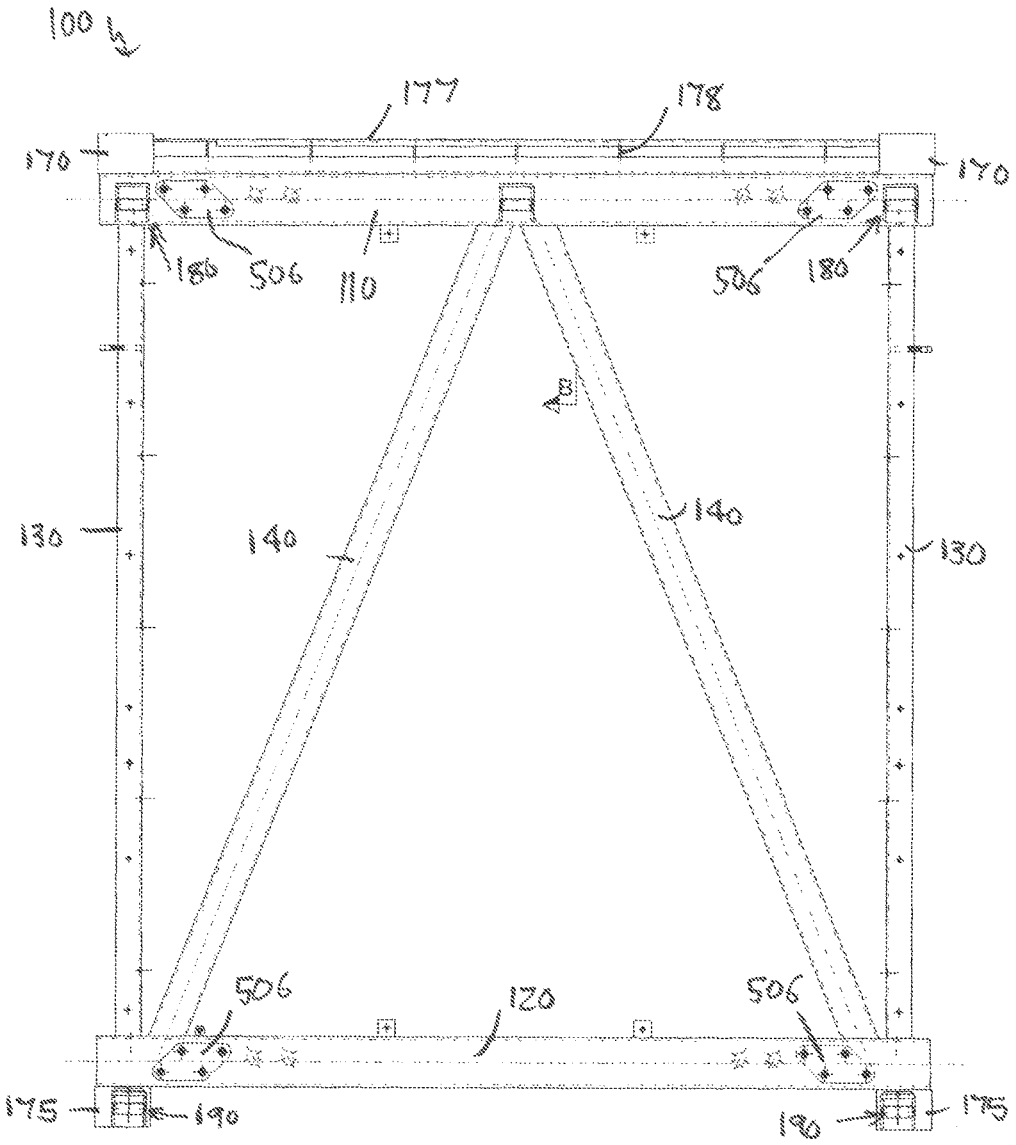
FIG. 8 is a rear elevation view of the first frame of the access module of FIG. 1.
Figure 9:
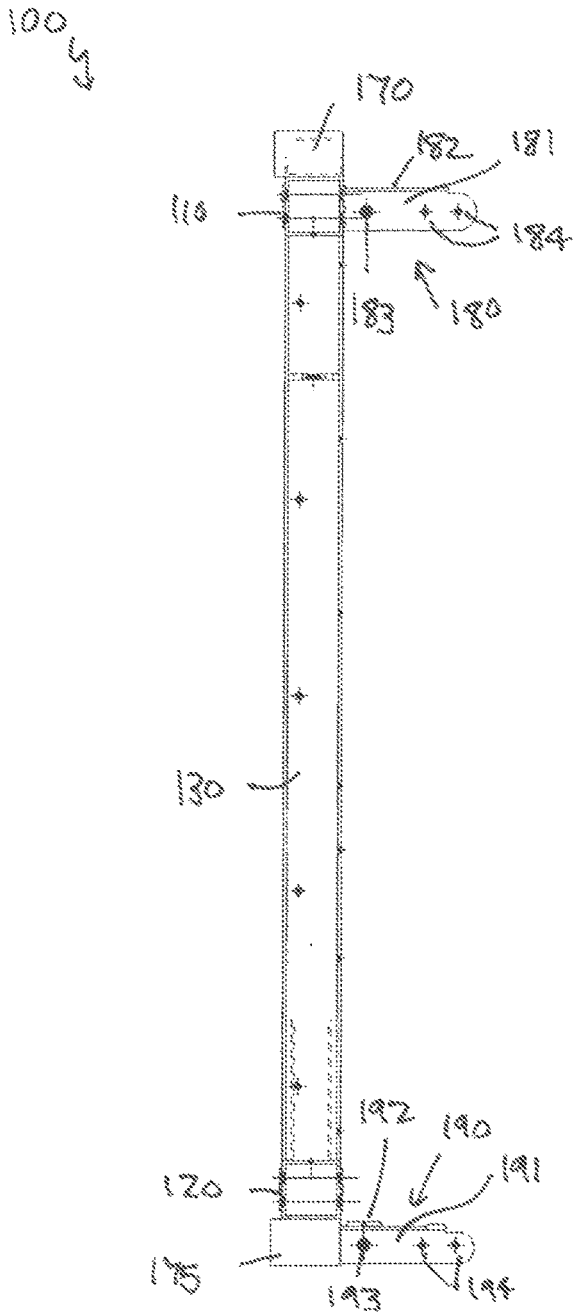
FIG. 9 is a right end view of the first frame of FIG. 8.
Figure 10:
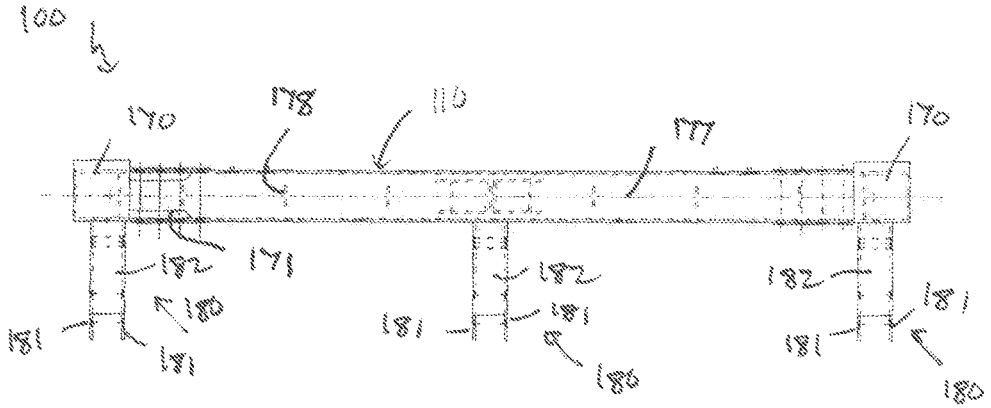
FIG. 10 is a plan view of the first frame of FIG. 8.
Figure 11:
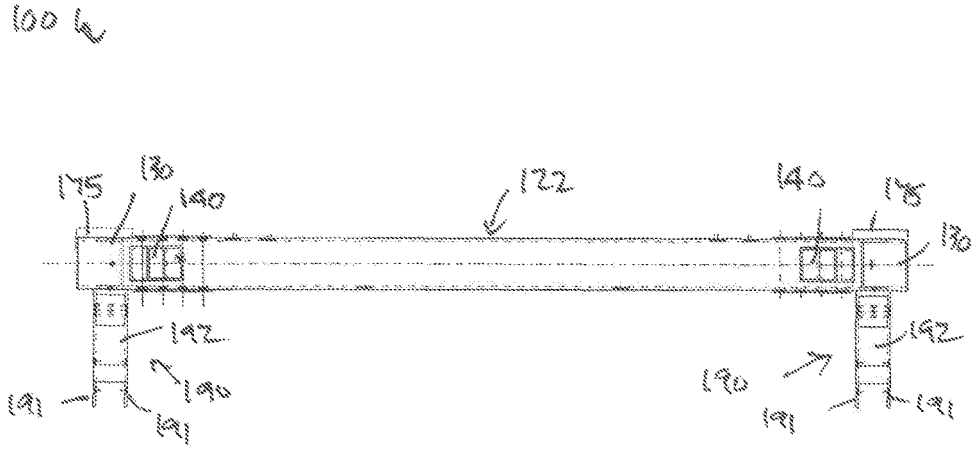
FIG. 11 is a cross-sectional plan view of the first frame of FIG. 8 taken at a section above the lower chord.
Figure 12:
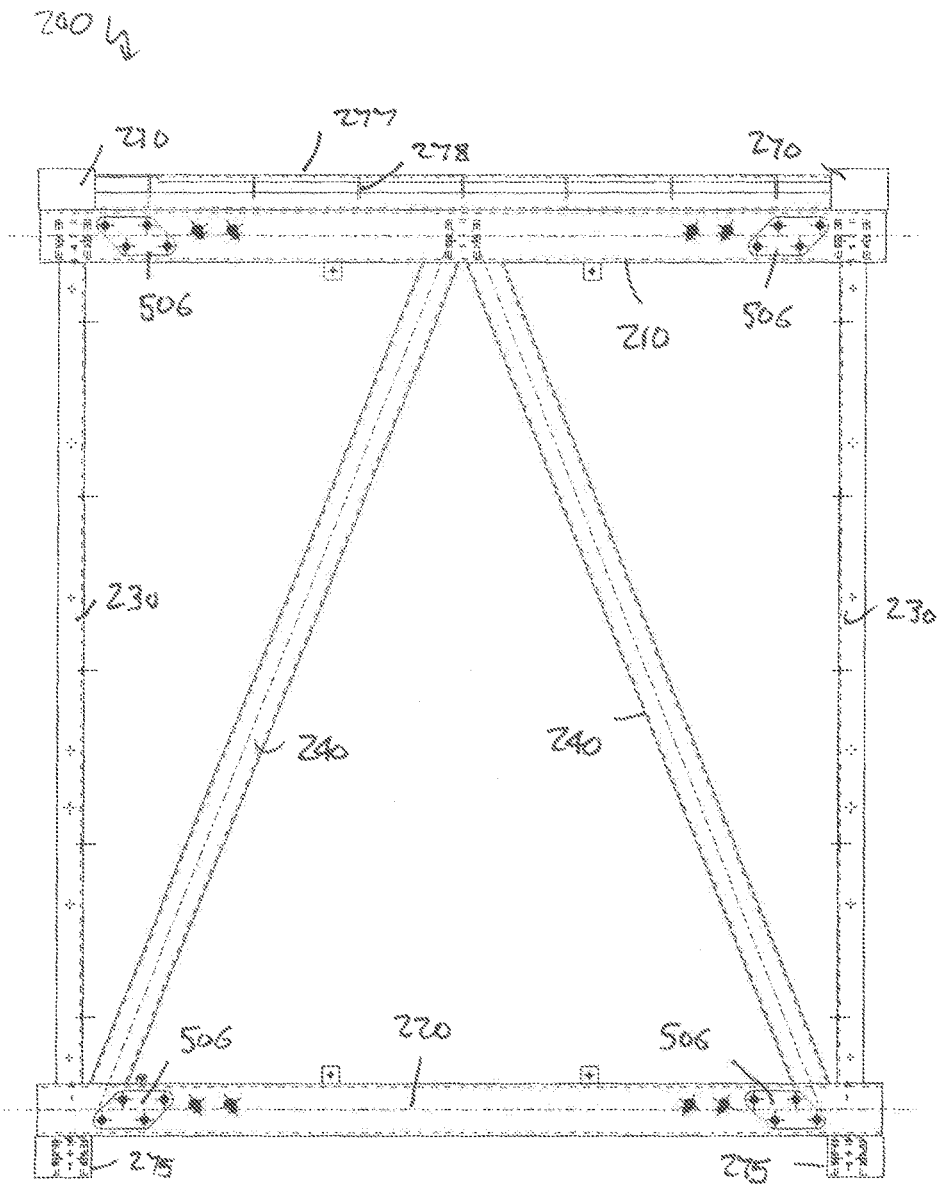
FIG. 12 is a rear elevation view of the second frame of the access module of FIG. 1.
Figure 13:
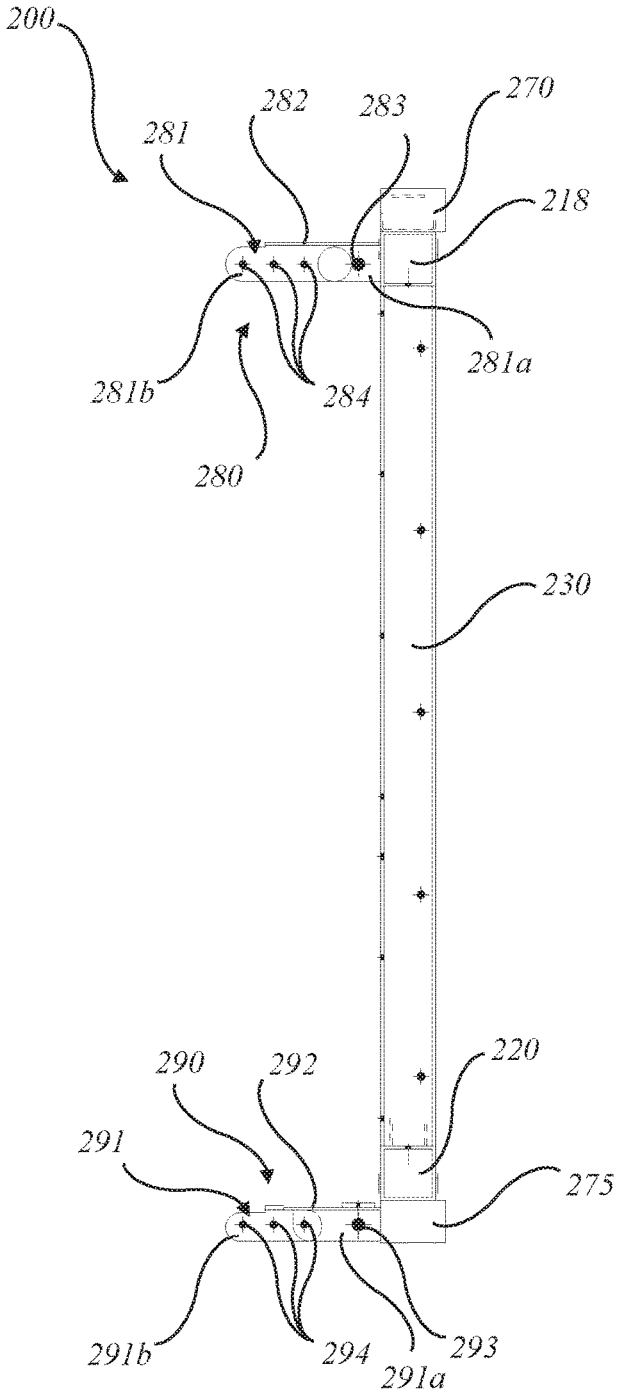
FIG. 13 is a right end elevation view of the second frame of FIG. 12.
Figure 14:
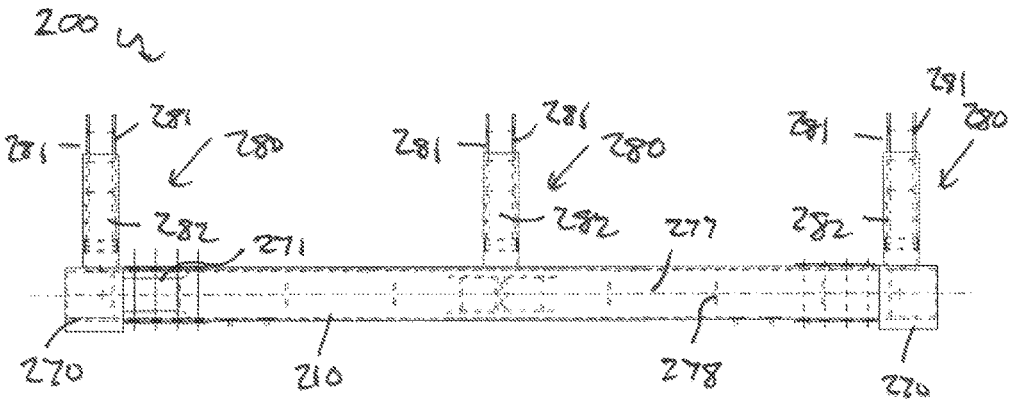
FIG. 14 is a top plan view of the second frame of FIG. 12.
Figure 15:
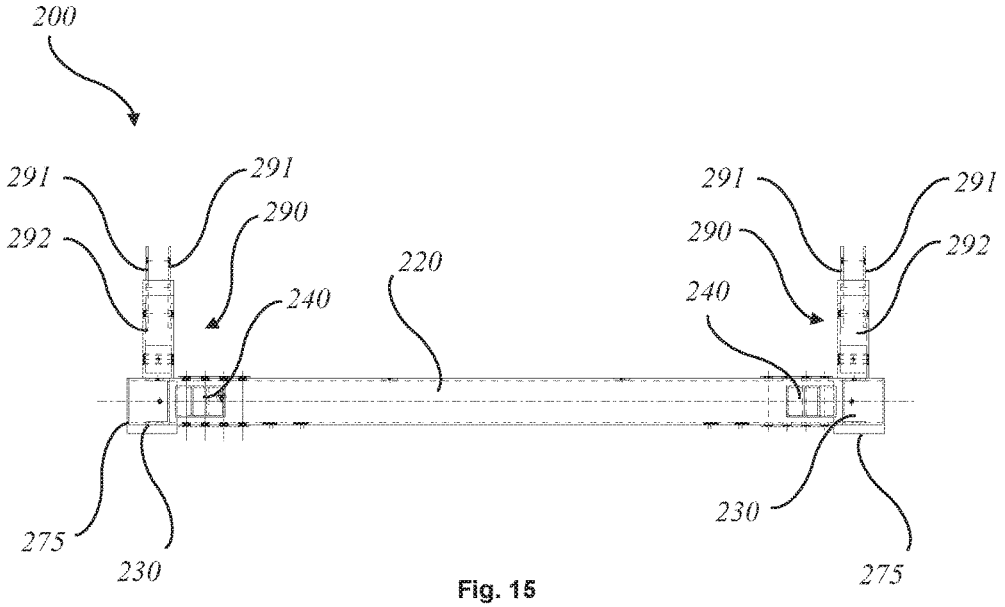
FIG. 15 is a cross-sectional plan view of the second frame of FIG. 12 taken at a section above the lower chord.

The access module 1 is configurable by deformation of the lower and upper support structures 300, 400 between an extended configuration, as shown in FIGS. 1 to 5, and a collapsed configuration as shown in FIGS. 6 and 7. In the extended configuration, the frames are spaced apart a first distance that equates to the width of the deck 360, which is generally horizontal when the access module 1 is in the extended configuration. The extended configuration is for use of the access module. In the collapsed configuration, the distance between the first and second frames 100, 200 is reduced, being a distance less than the first distance. In the particular embodiment depicted, the first and second frames 100, 200 are engaged when in the collapsed configuration, as will be further discussed below. The collapsed configuration reduces the overall size of the access module 1, and is thus particularly suitable for transport of the access module 1.

The first frame 100 is depicted in greater detail in FIGS. 8 to 11. The first frame comprises a longitudinally extending upper chord 110 and a longitudinally extending lower chord 120. The first frame 100 further comprises a pair of upright columns, typically referred to as verticals 130, located at the opposing longitudinal ends of the first frame 100 and a pair of inclined members, typically referred to as diagonals 140, each extending from opposing ends of the lower chord 120 adjacent to the verticals 130 to a central region of the upper chord 110. The upper and lower chords 110, 120, the verticals 130 and the diagonals 140 are typically formed of structural grade steel and are welded to each other to form a rigid truss structure.

In the embodiment depicted, a mesh screen 150 is secured to the inwardly directed face of the upper and lower chords 110, 120 and verticals 130 of the first frame 100. A hand rail 155 is also provided, extending along the longitudinal length of the first frame 100 with opposing ends of the hand rail 155 secured to each of the verticals 130.

The first frame 100 further comprises a pair of top corner blocks 170 and a pair of bottom corner blocks 175. The top corner blocks 170 are mounted towards the opposing longitudinal ends of the upper chord 110, projecting upwardly from the upper chord 110. The bottom corner blocks 175 are mounted toward the opposing longitudinal ends of the lower chord 120, projecting downwardly from the lower chord 120. The corner blocks 170, 175 are of the same general form as corner blocks mounted on standard ISO cargo containers, and particularly may comprise corner fittings according to ISO 1161:2016 (equivalent to AS/NZS3711). Each of the corner blocks 170, 175 has openings in its side and top/bottom surfaces (not depicted) for engaging standard twist-locks as used in the handling of cargo containers, both for lifting the access module 1 and for connecting multiple access modules 1 for transportation, as will be further discussed below.

The first frame 100 further comprises a roofing attachment element 177 mounted to, and spaced from, the upper face of the upper chord 110 by way of a plurality of upright spacers 178. The roofing attachment element 177 extends between the top corner blocks 170. The roofing attachment element 177 projects laterally beyond the spacers 178 so as to define a longitudinally extending channel 179 defined between the upper face of the upper chord 110 and the lower face of the roofing attachment element 177. As will be discussed below, the channel 179 serves to retain decking boards which may be used for form a roof of the access module 1. A cutout 171 is formed at one end of the roofing attachment element 177 to assist in the insertion of the decking boards as will also be discussed further below. A membrane attachment channel 172 is mounted to, and extends between, the inwardly directed faces of the verticals 130. The membrane attachment channel 172 serves for securing a roofing membrane to the access module 1, as will also be further discussed below.

Referring to FIG. 1, a plurality of adapter brackets 160, 165 may be secured to the outwardly directed and inwardly directed faces of the first frame 100 by way of keyhole shaped apertures provided on various elements of the first frame 100. The adapter brackets 160, 165 depicted are particularly configured to act as fixing points for a scaffolding system that may be used in conjunction with the access module 1. In the embodiment depicted, the adapter brackets 160 are mounted to the upper chord 110 and are each in the form of a half rosette for securing to the end of a strut of a ring lock type of scaffolding system, such as a Layher® Allround Scaffolding System. The adapter brackets 165 are secured to one of the verticals 130 and are each in the form of an attachment pin also for securing to a ring lock type of scaffolding system, such as the Layher® Allround Scaffolding System.

Referring specifically to FIGS. 8 to 11, the first frame 100 further comprises a plurality of laterally projecting upper stubs 180. The upper stubs 180 are mounted to the inwardly directed face of the upper chord 110. It is envisaged, however, that the upper stubs 180 may be otherwise mounted adjacent to the upper chord 110, such as to the top blocks 170 or toward the upper end of the verticals 130 and/or diagonals 140. In the embodiment depicted, three upper stubs 180 are provided, towards opposing longitudinal ends and at the centre of the upper chord 110. The upper stubs 180 serve to attach the upper support structure 400 to the first frame 110, as will be further discussed below. Each of the upper stubs 180 comprises a pair of opposing upright flanges 181, projecting from a proximal end welded to the upper chord 110 to a distal end, and a horizontally disposed web 182 spanning between the upper edges of the flanges 181. The flanges 181 project beyond the distal end of the web 182. A pivot pin aperture 183 extends through the flanges 181 adjacent the proximal end of each flange 181. A pair of locking pin apertures 184 extend through the flanges 181 toward the distal end of each flange 181.

The first frame 100 further comprises a plurality of laterally projecting lower stubs 190. The lower stubs 190 are mounted adjacent to the lower chord 120, specifically to the inwardly directed face of each of the bottom blocks 175. It is envisaged, however, that the lower stubs 190 may be otherwise mounted directly to the lower chord 120. In the embodiment depicted, two lower stubs 190 are provided. The lower stubs 190 serve to attach the lower support structure 300 to the first frame 100, as will be further discussed below. Each of the lower stubs 190 comprises a pair of opposing upright flanges 191, projecting from a proximal end welded to the lower chord 120 to a distal end, and a horizontally disposed web 192 spanning between the upper edges of the flanges 191. The flanges 191 project beyond the distal end of the web 192. A pivot pin aperture 193 extends through the flanges 191 adjacent the proximal end of each flange 191. A pair of locking pin apertures 194 extend through the flanges 191 toward the distal end of each flange 191.

The second frame 200 is substantially identical to the first frame 100. Accordingly, identical or equivalent features of the second frame are annotated in the accompanying drawings with identical reference numerals, incremented by one hundred. In particular, the second frame 200 has an upper chord 210, lower chord 220, verticals 230, diagonals 240 and top and bottom corner blocks 270, 275 identical to the corresponding features of the first frame 100. A mesh screen 150 is secured to the inwardly directed face of the upper and lower chords 210, 220 and verticals 230 and a hand rail 155 extends along longitudinal length of the second frame 200 with opposing ends secured to each of the verticals 230. The second frame 200 also has a roofing attachment element 277 and associated spacers 278, channel 279 and cutout 271 identical to the corresponding features of the first frame 100. A membrane attachment channel 272 is also provided, identical to the corresponding membrane attachment channel 171 of the first frame 100.

The second frame 200 further has three laterally projecting upper stubs 280 and two laterally projecting lower stubs 290 projecting from the inwardly directed face of the second frame 200. The upper stubs 280 oppose and correspond to the upper stubs 180 of the first frame 100. The lower stubs 290 oppose and correspond to the lower stubs 190 of the first frame 100.

The upper stubs 280 are of the same general form as the upper stubs 180 of the first frame 100, comprising a pair of opposing flanges 281, an upper web 282, pivot pin apertures 283 and locking pin apertures 284, although three locking pin apertures 284 are provided, as compared to two locking pin apertures 184 as provided on each of the upper stubs 180 of the first frame 100. Each of the flanges 281 of each upper stub 280 has a proximal flange portion 281*a* and a distal flange portion 281*b*. The distal flange portions 281*b* are separated by a narrower distance than the distance separating the flanges 181 of the upper stubs 180 of the first frame 100, such that the distal flange portions 281*b* are able to be received between the flanges 181 with the corresponding locking pin apertures 184, 284 aligned, as will be further discussed below.

The lower stubs 290 are of the same general form as the lower stubs 190 of the first frame 100, comprising a pair of opposing flanges 291, an upper web 292, pivot pin apertures 293 and locking pin apertures 294, although again three locking pin apertures 294 are provided, as compared to two locking pin apertures 194 as provided on each of the lower stubs 190 of the first frame 100. Each of the flanges 291 of each lower stub 290 has a proximal flange portion 291*a* and a distal flange portion 291*b*. The distal flange portions 291*b* are separated by a narrower distance than the distance separating the flanges 191 of the lower stubs 190 of the first frame 100, such that the distal flange regions 291*b* are able to be received between the flanges 191 with the corresponding locking pin apertures 194, 294 aligned, as will be further discussed below.

The access module 1 has a plurality of connectors, here in the form of spigots 500, for fastening the access module 1 end to end with an identical second access module. In particular, each of the spigots 500 is adapted to fasten one of the chords 110, 120, 210, 220 of one of the frames 100, 200 to a corresponding chord of the corresponding frame of the second access module. In the arrangement depicted, each of the spigots 500 is identical and is mounted to one of the longitudinal ends of the respective chord 110, 120, 210, 220. In the preferred embodiment depicted, each of the upper and lower chords 110, 120, 210, 220 comprises a hollow structural section (HSS) and particularly a rectangular hollow section (RHS), with each spigot 500 being mounted in the hollow of the respective chord 110, 120 210, 220. Each of the spigots 500 is in the form of an elongate box section having opposing side walls 501, an upper wall 502 and a lower wall 503.

A set of apertures 504 is provided through each side wall 501 towards each opposing longitudinal end of the spigot 500. The apertures 504 are arranged to align with corresponding apertures 505 provided in the side walls of the respective chord 110, 120, 210, 220, and overlying doubler plates 506 provided for local reinforcing of the chord. Fasteners (not depicted) extend through the aligned apertures 504, 505 to secure the spigot 500 to the respective chord 110, 120, 210, 220. By removing the fasteners, each spigot 500 is displaceable between a protruding configuration, as shown in FIG. 1, in which the spigot 500 protrudes from the end of the respective chord 110, 120, 210, 220 and a retracted configuration in which the spigot 500 is retained wholly within the chord 110, 120, 210, 220. The spigots 500 may be retained in the retracted configuration by aligning at least one of the apertures 504 adjacent the opposing end of the spigot 500 with at least one of the apertures 505 in the chord 500 and extending a fastener through the aligned apertures 504, 505. The spigots 500 are typically retained in the retracted configuration during transportation and displaced to the protruding configuration when required to fasten the access module 1 to a second access module.

Spigots 500 are typically mounted in one end only of each of the chords 110, 120, 210, 220, leaving the opposing end of each chord 110, 120, 210, 220 to receive the protruding spigot of an adjoining access module. As well as fastening the two adjacent access modules 1, the spigots 500 act to transfer loads between the corresponding chords 110, 120, 210, 220 of adjacent access modules 1, such that the chords of adjoining access modules 1 effectively structurally act as a single elongate chord.

Referring to FIGS. 1 to 5, the upper support structure 400 comprises a plurality of longitudinally spaced and laterally extending lateral struts 410, typically formed of structural grade steel. In the arrangement depicted, three lateral struts 410 are provided, spaced along the longitudinal length of the access module 1. Opposing ends of each lateral strut 410 are pivotally attached to the first frame 100 and second frame 200 respectively, here by way of the upper stubs 180, 280. Each lateral strut 410 comprises a first strut segment 420 and a second strut segment 430 that is pivotally attached to the first strut segment 420. It is envisaged that more than two articulating strut segments may be utilized to form each lateral strut if desired.

Each first strut segment 420 comprises a pair of elongate opposing upright flanges 421 and a horizontally disposed web 422 spanning between the lower edges of the flanges 421. The flanges 421 project beyond the proximal and distal ends of the web 422. First and second pivot pin apertures 423, 424 extend through the flanges 421 adjacent the proximal and distal ends of the flanges 421 respectively. A first locking pin aperture 425 extends through the flanges 421 adjacent the first pivot pin aperture 423 and a second locking pin aperture 426 extends through the flanges 421 adjacent the second pivot pin aperture 424.

Each second strut segment 430 comprises a pair of elongate opposing upright flanges 431 and a horizontally disposed web 432 spanning between the lower edges of the flanges 431. The flanges 431 project beyond the proximal and distal end ends of the web 432. First and second pivot pin apertures 433, 434 extend through the flanges 431 adjacent the proximal and distal ends of the flanges 431 respectively. A first locking pin aperture 435 extends through the flanges 431 adjacent the first pivot pin aperture 433 and a second locking pin aperture 436 extends through the flanges 431 between the second pivot pin aperture 434 and the distal end of the flanges 431.

Each first strut segment 420 is pivotally attached to one of the upper stubs 180 of the first frame 100, with the upper stub 180 received between the flanges 421 at the proximal end of the first strut segment 420 and the pivot pin aperture 183 of the upper stub aligned with the first pivot pin aperture 423 of the first strut segment 420. A pivot pin extends through the pivot pin aperture 183 and the first pivot pin aperture 423 to form the pivotal connection. Similarly, the proximal end of the second strut segment 430 is pivotally attached to one of the upper stubs 280 of the second framed 200 in the same manner, with a pivot pin extending through the pivot pin aperture 283 of the upper stub 280 and the first pivot pin aperture 433 of the second strut segment 430. The second strut segment 430 is pivotally attached to the first strut segment 420 with a distal flange region 431*b* of each of the flanges 431 being separated by a reduced distance so as to be received between the flanges 421 of the first strut segment 420 with the second pivot pin apertures 424, 434 of the first and second strut segments 420, 430 aligned. A pivot pin extends through the second pivot pin apertures 424, 434 to form the pivotal connection.

Figure 3:
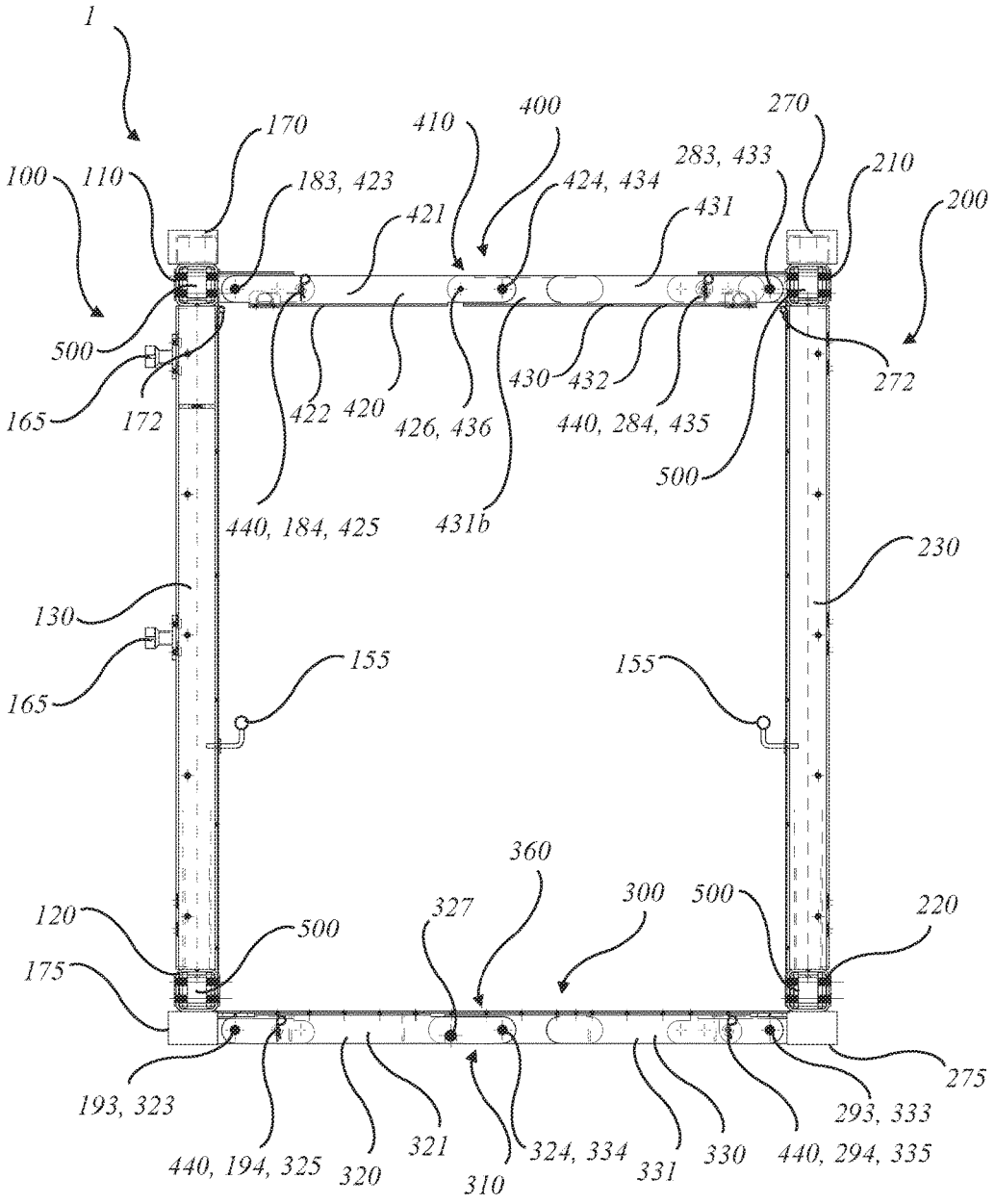
FIG. 3 is an end elevation view of the access module of FIG. 1.
Figure 4:
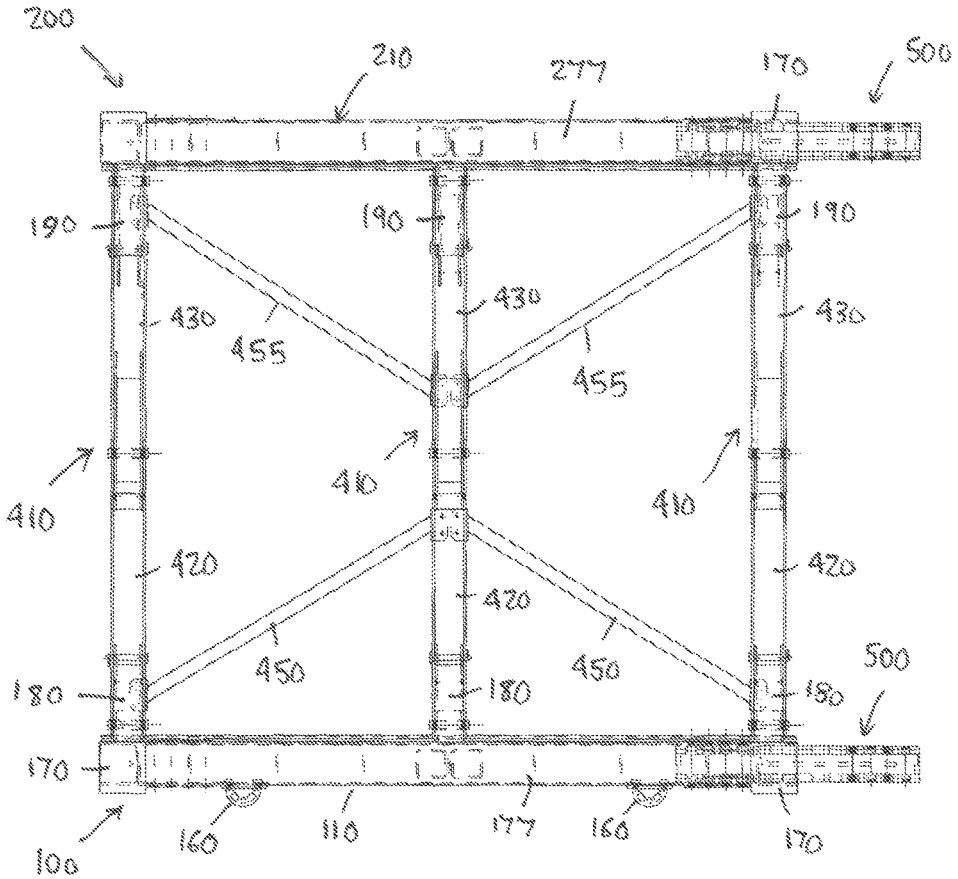
FIG. 4 is a plan view of the access module of FIG. 1.

As best seen in FIG. 3, when the access module 1 is in the extended configuration the first and second strut segments 420, 430 of each lateral strut 410 extend substantially collinearly. As also best seen in FIG. 3, when the access module 1 is in the extended configuration, the lateral strut 410 may be locked by way of one or more locking pins 440. In the arrangement depicted, one locking pin 440 extends through the first locking pin aperture 425 of the first strut segment 420 and one of the locking apertures 184 of the upper stub 180. A second locking pin 440 extends through the first locking pin aperture 435 of the second strut segment 430 and one of the locking pin apertures 284 of the upper stub 280 of the second frame 200. If desired, a further locking pin may be extended through the second locking pin apertures 426, 436 of the first and second strut segments 420, 430.

The upper support structure 400 further comprises a set of four braces 450, 455. The two braces 450 are fixed to, and extend from, the first strut segments 420 located at each longitudinal end of the access module 1 to the central first strut segment 420 located at the centre of the access module 1. The braces 450 extend diagonally from adjacent the proximal end of the first strut segments 420 at the ends of the access module 1 to adjacent the distal end of the central first strut segment 420. The struts 450 provide enhanced rigidity and assist in ensuring the first strut segments 420 pivot relative to the first frame 100 in unison. Similarly, the braces 455 are fixed to extend from the second strut segment 430 located adjacent the longitudinal ends of the access module 1 to the second strut segment 430 located at the centre of the access module 1. The braces 455 again extend diagonally and also enhance rigidity and assist in ensuring that the second strut segments 430 pivot relative to the second frame 200 in unison.

Referring to FIGS. 1 to 5, the lower support structure 300 comprises a plurality of longitudinally spaced and laterally extending floor beams 310. In the arrangement depicted, two floor beams 310 are provided, at opposing ends of the access module 1. Opposing ends of each floor beam 310 are pivotally attached to the first frame 100 and second frame 200 respectively, here by way of the lower stubs 190, 290. Each floor beam 310 comprises a first beam segment 320 and a second beam segment 330 that is pivotally attached to the first beam segment 320. It is envisaged that more than two articulating beam segments may be utilized to form each floor beam if desired.

Each first beam segment 320 comprises a pair of elongate opposing upright flanges 321 and a horizontally disposed web 322 spanning between the upper edges of the flanges 321. The flanges 321 project beyond the proximal and distal end ends of the web 322. First and second pivot pin apertures 323, 324 extend through the flanges 321 adjacent the proximal and distal ends of the flanges 321 respectively. A first locking pin aperture 325 extends through the flanges 321 adjacent the first pivot pin aperture 323 and a second locking pin aperture 326 extends through the flanges 321 adjacent the second pivot pin aperture 324. A fixed locking pin 327 extends through the locking pin aperture 326.

Each second beam segment 330 comprises a pair of elongate opposing upright flanges 331 and a horizontally disposed web 332 spanning between the upper edges of the flanges 331. The flanges 331 project beyond the proximal and distal end ends of the web 332. First and second pivot pin apertures 333, 334 extend through the flanges 331 adjacent the proximal and distal ends of the flanges 331 respectively. A first locking pin aperture 335 extends through the flanges 331 adjacent the first pivot pin aperture 333 and a locking pin recess 336 extends through the flanges 331 between the second pivot pin aperture 334 and the distal end of the flanges 331.

Each first beam segment 320 is pivotally attached to one of the lower stubs 190 of the first frame 100, with the lower stub 190 received between the flanges 321 at the proximal end of the first beam segment 320 and the pivot pin aperture 193 of the lower stub 190 aligned with the first pivot pin aperture 323 of the first beam segment 320. A pivot pin extends through the pivot pin aperture 193 and first pivot pin aperture 323 to form the pivotal connection. Similarly, the proximal end of the second beam segment 330 is pivotally attached to one of the lower stubs 290 of the second framed 200 in the same manner, with a pivot pin extending through the pivot pin aperture 293 of the lower stub 290 and the first pivot pin aperture 333 of the second beam segment 330. The second beam segment 330 is pivotally attached to the first beam segment 320 with a distal flange portion 331*b* of each of the flanges 331 being separated by a reduced distance so as to be received between the flanges 321 of the first beam segment 320 with the second pivot pin apertures 324, 334 of the first and second beam segments 320, 330 aligned. A pivot pin extends through the second pivot pin apertures 324, 334 to form the pivotal connection.

As best seen in FIG. 3, when the access module 1 is in the extended configuration the first and second beam segments 320, 330 extend substantially collinearly. As also best seen in FIG. 3, when the access module 1 is in the extended configuration, the lateral beams 320 may be locked by way of one or more locking pins 440. In the arrangement depicted, one locking pin 440 extends through the first locking pin aperture 325 of the first beam segment 320 and one of the locking apertures 194 of the lower stub 190. A second locking pin 440 extends through the first locking pin aperture 335 of the second beam segment 330 and one of the locking pin apertures 294 of the lower stub 290 of the second frame 200. The fixed locking pin 327 extending through the second locking pin aperture 326 of the first beam segment 320 also engages the locking pin recess 336 of the second beam segment 330. The locking pin recess 336, which extends downwardly, engages the fixed locking pin 327 to prevent the floor beam 310 deflecting downwardly beyond the linearly extending configuration.

The lower support structure 300 further comprises a set of longitudinally extending stringers 350, 355 as best shown in FIG. 5. Two stringers 350 are fixed to and extend longitudinally between the first beam segments 320 whilst the two stringers 350 are fixed to and extend longitudinally between the second beam segments 330.

The deck 360 comprises a first deck section 361 that is mounted on and fixed to the first beam segments 320 and the stringers 350 and a second deck section 362 that is mounted on and fixed to the second beam segments 330 and the stringers 355. As best shown in FIGS. 1 and 5, the deck sections 361, 362 substantially abut when the access module 1 is in the extended configuration so as to define a substantially continuous upper deck surface for the passage of pedestrians or vehicles.

The access module 1 is configurable by deformation of the lower and upper support structures 300, 400 between the extended configuration shown in FIGS. 1 to 5 and the collapsed configuration shown in FIGS. 6 and 7, particularly by articulation of the floor beams 310 and lateral struts 410. The floor beams 310 articulate by pivoting the first and second beam segments 320, 330 upwardly about the lower stubs 190, 290 such that the beam segments 320, 330 are angularly inclined when the access module 1 is in the collapsed configuration. The lateral struts 410 articulate by pivoting the first and second strut segments 420, 430 downwardly about the upper stubs 180, 280, again such that the first and segment strut segments 320, 330 are angularly inclined when the access module 1 is in the collapsed configuration.

As also shown in FIGS. 6 and 7, when the access module 1 is in the collapsed configuration, the corresponding upper stubs 180, 190 of the first and second frames 100, 200 engage and the corresponding lower stubs 190, 290 of the first and second frames 100, 200 also engage. In particular, when the access module 1 is in the collapsed configuration, the distal flange portions 281*b* of the upper stubs 280 of the second frame 200 are received between the flanges 181 of the upper stubs 180 of the first frame 100 with the corresponding locking pin apertures 184, 284 aligned. Locking pins 440 may then be extended through the aligned locking pin apertures 184, 284 so as to lock the access module 1 in the collapsed configuration. The distal flange portions 291*b* of the lower stubs 290 of the second frame 200 are also received between the flanges 191 of the lower stubs 190 of the first frame 100 with the corresponding locking pin apertures 194, 294 aligned. The locking pins 440 may then be extended through the aligned locking pin apertures 194, 294 so as to further lock the access module 1 in the collapsed configuration. Having the access module 1 locked in the collapsed configuration makes it particularly suitable for transport, occupying a smaller volume and ensuring that the access module 1 is held securely in the collapsed configuration. In the embodiment depicted, the access module 1 has an overall span length of 2378 mm, overall height of 2896 mm and overall width of 2438 when in the extended configuration. In the collapsed configuration, the access module 1 has a reduced width of 946 mm.

Figure 18:
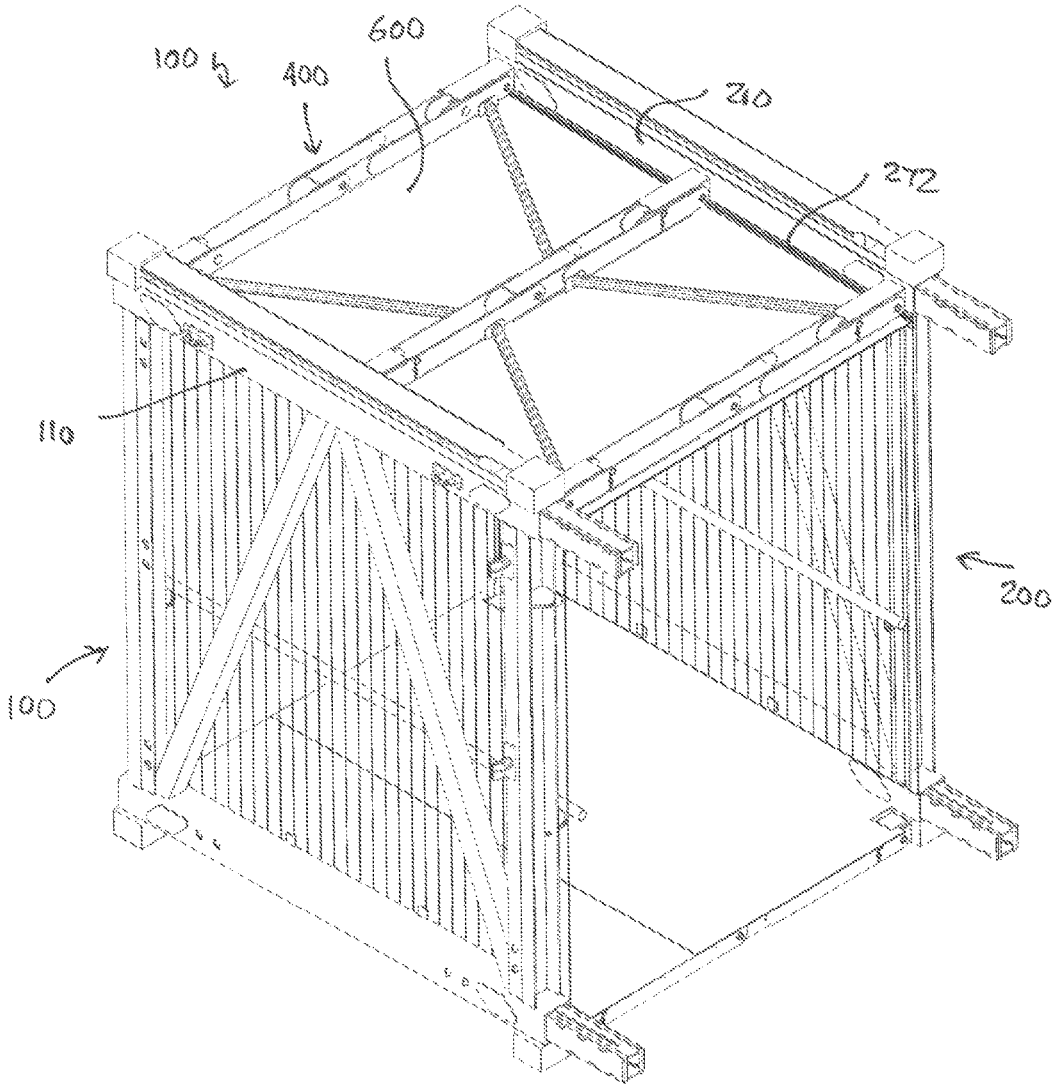
FIG. 18 is an isometric view of the access module of FIG. 1 with a waterproof membrane extending between the first and second frames.

Referring to FIG. 18, weather protection may be provided to the access module 1 by way of a waterproof roofing membrane 600 located adjacent the upper support structure 400. In the embodiment depicted, the waterproof roofing membrane 600 is secured to, and extended between, the membrane attachment channels 172, 272 of the first and second frames 100, 200 respectively, such that the roofing membrane 600 extends underneath and adjacent to the upper support structure 400. The waterproof roofing membrane 600 may merely provide weather protection to pedestrians or workers accessing a modular bridge structure formed from the access modules 1, or weather protection and some basic overhead protection from falling objects when used as a modular overhead protection structure on construction sites.

Figure 19:
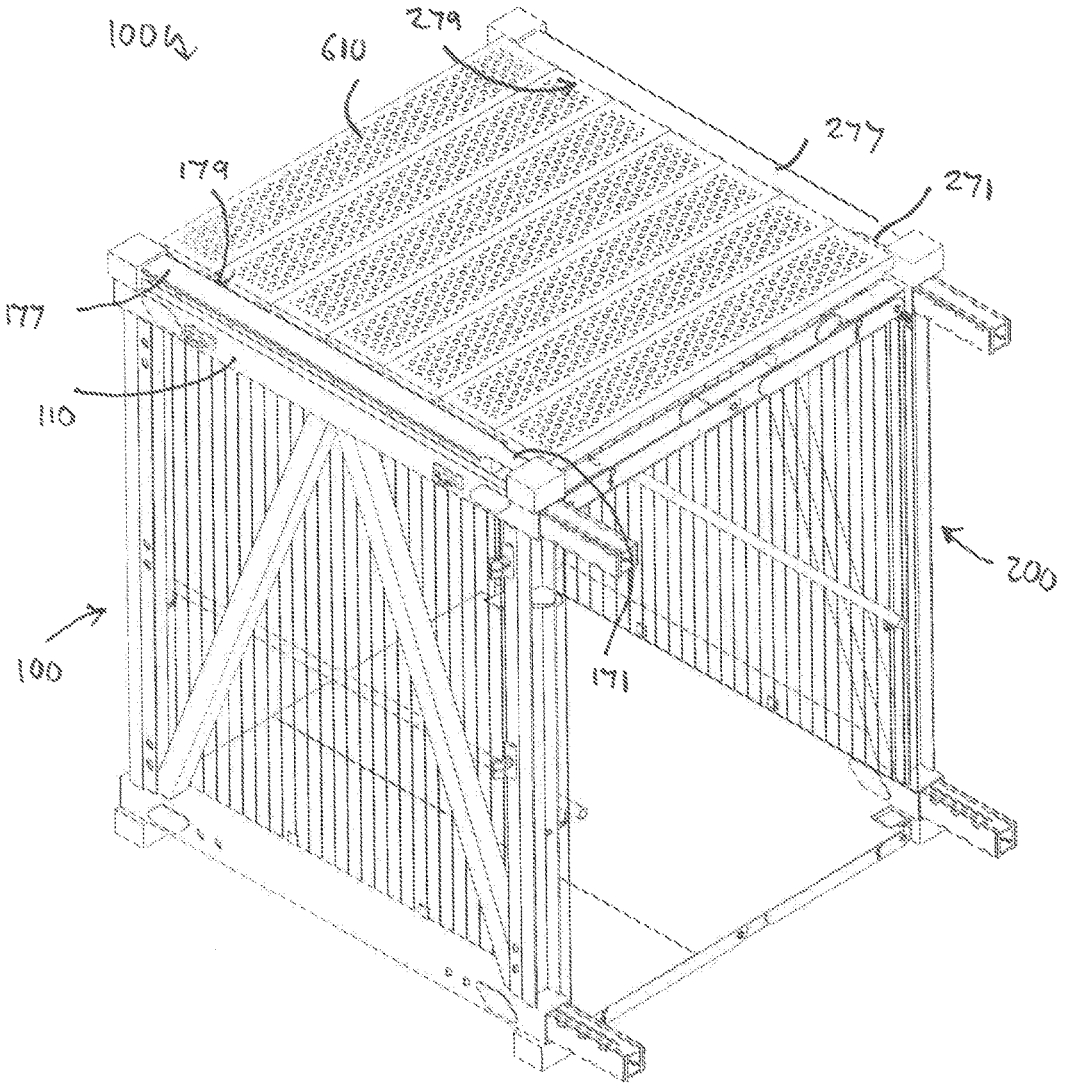
FIG. 19 is an isometric view of the access module of FIG. 1 with a decking form of roof extending between the upper chords of the first and second frames.
Figure 20:
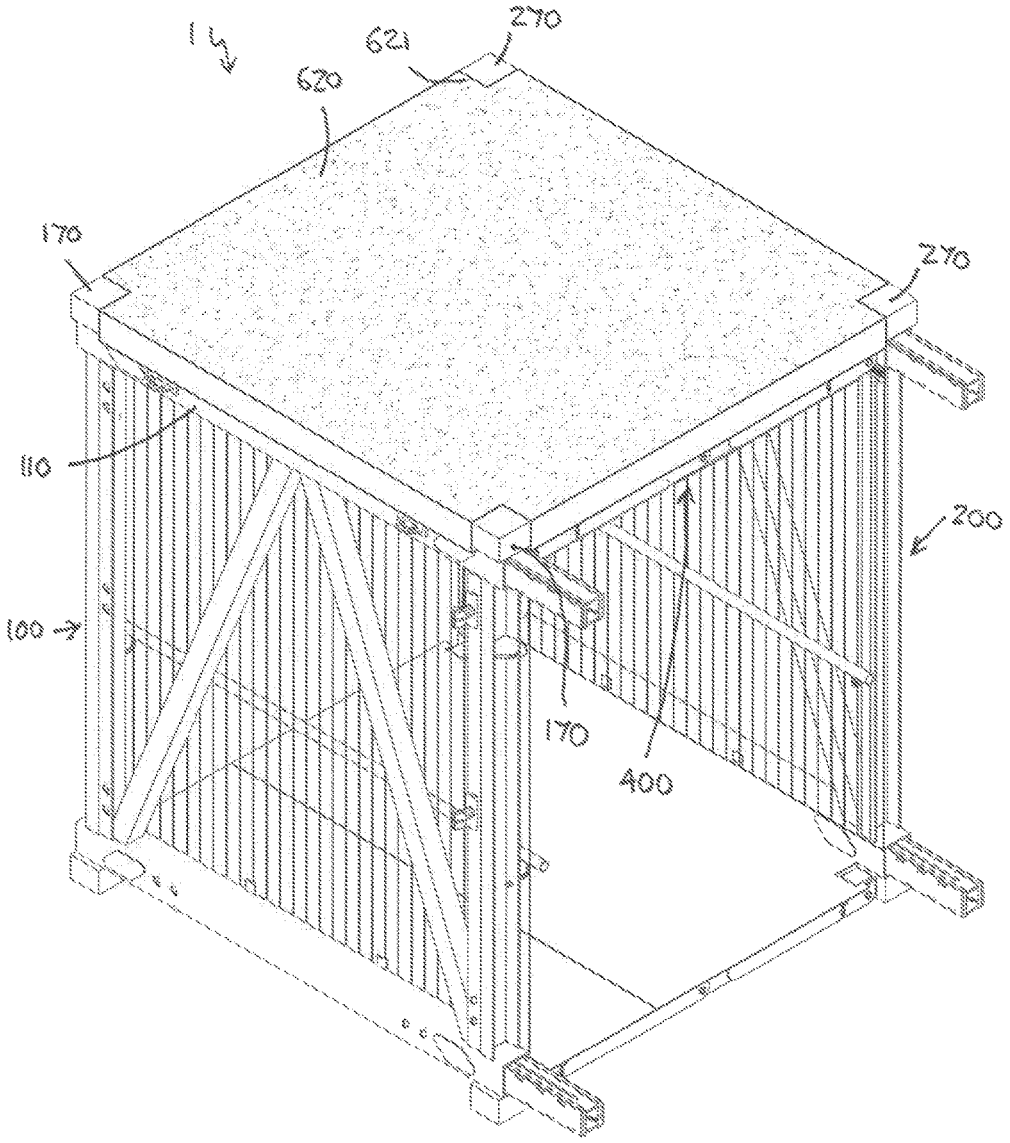
FIG. 20 is an isometric view of the access module of FIG. 1 with a concrete slab form of roof extending between the upper chords of the first and second frames.

More substantial overhead protection from falling objects on construction sites may be provided by mounting a more substantial roofing structure on each of the access modules 1. In the arrangement depicted in FIG. 19, a roofing structure in the form of a plurality of laterally extending steel decking boards 610 is mounted on, and extends between, the upper chords 110, 210 of the first and second frames 100, 200. In particular, the roof decking boards 610 are each sized so as to have opposing ends received in the channels 179, 279 defined beneath each of the roofing attachment elements 177, 277. Each of the decking boards 610 may be fitted into the channels 179, 279 by having each opposing end aligned with the cutouts 171, 271 at the end of each of the roofing attachment elements 177, 277, allowing the decking boards 610 to be loaded into the channels 179, 279 and then pushed along the upper chords 110, 210 toward the opposing end of the access module 1. The decking boards 610 are load bearing and provide protection from objects falling from an adjacent construction site and may also be utilised as a platform for workers and equipment associated with the construction site. A more substantial roofing structure may be provided in the form of a concrete slab 620, as depicted in FIG. 20. In this arrangement the concrete slab 620 has corner cutouts 621 sized and located so as to fit the concrete slab 620 between the top corner blocks 170, 270. In this configuration, the roofing attachment elements 177, 277 are omitted. The top corner blocks 170, 270 serve to securely locate the concrete slab 620 on the top of the access module 1, supported by and spanning between the upper chords 110, 210 and further supported by the upper support structure 400. The concrete slab 620 of each access module 1 forms a continuous overhead protection roofing therefore to the module access structure and provides a deck for support of workers and equipment associated with the construction site.

Figure 16:
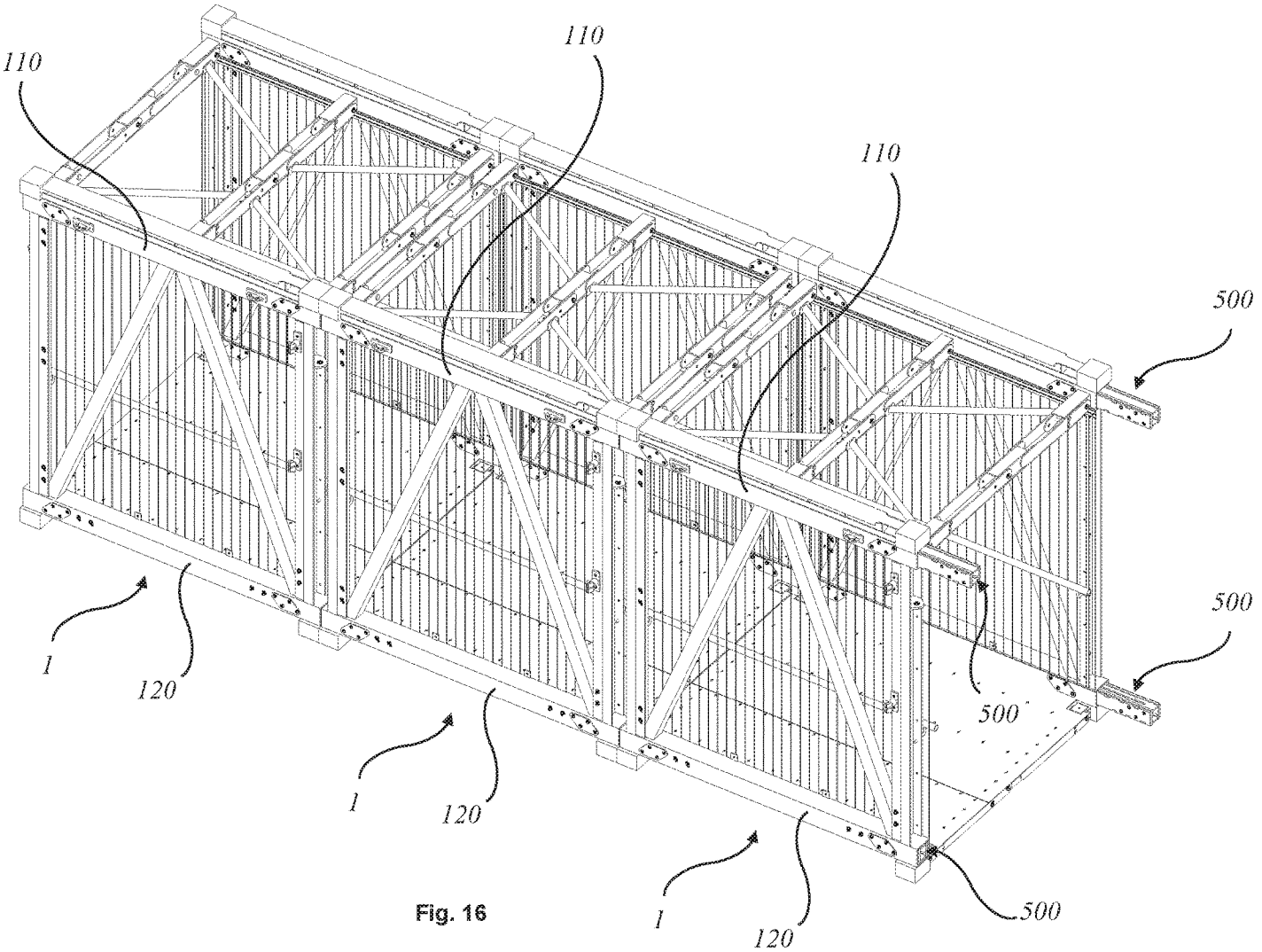
FIG. 16 is an isometric view of a modular bridge structure comprising three access modules of FIG. 1.

Now referring to FIG. 16, a modular access structure may be provided by first aligning two or more of the access modules 1 longitudinally end to end when in the extended configuration, such that the corresponding lower chords 120, 220 of each access module 1 are arranged end to end and the corresponding upper chords 110, 210 of each access module 1 are arranged end to end. The corresponding lower chords 120, 220 of adjacent access modules 1 are fastened end to end to form a single load bearing elongate lower chord assembly. The corresponding upper chords 110, 210 of adjacent access modules 1 may also be fastened end to end to form a single load bearing elongate upper chord assembly. The access modules 1 are arranged such that one spigot 500 is provided to form the connection between the corresponding chords 110, 120, 210, 220 of each access module 1, with each spigot 500 fixed to one of the chords in the projecting configuration and inserted into the end of the mating chord of the adjacent access module 1 as the access modules 1 are aligned and fitted together. The apertures 504 toward the projecting end of the spigot 500 are aligned with the corresponding apertures 505 of the mating chord and fasteners extended therethrough so as to securely fasten the mating chords and form an access assembly. Further access modules 1 may then be aligned and fastened to the end of the access assembly formed until the length of the access assembly exceeds the length to be spanned.

The modular access structure may be utilised as a modular bridge structure to span a gap between two opposing points. The modular bridge structure may be used in various environments, including on construction sites and to provide temporary bridge solutions following failure of, or prior to construction of, more permanent bridge structures. Whilst the modular access structure depicted is sized to provide access for pedestrians and workers, larger versions are envisaged that can be utilised as vehicular bridge structures. The access modules 1 may be assembled on site near the span to be accessed by the modular bridge structure, and the fully assembled modular bridge structure then lifted into position by way of several of the upper blocks 170, 270 so as to be supported at each end by a support on either end of the gap to be spanned. Alternatively, the modular bridge structure may be assembled in situ, with each access module 1 supported during assembly until the modular bridge structure is complete and self-supporting.

The modular access structure may also be utilised as an overhead protection structure, such as a hoarding, to provide overhead protection to pedestrians accessing a sidewalk or footpath alongside a construction site. In such an application, the modular access structure may be located at ground level, supported by the lower corner blocks 175, 275 of each (or some) of the access modules 1. In such a configuration, the mesh screen 150 of the first and/or second frames 100, 200 acts as a vertical hoarding providing protection to pedestrians from entering the construction site, and potentially falling into any adjacent excavation. Overhead protection may be provided by providing a roofing structure extending along the top of each access module 1. Such a roofing structure may take the form of, for example, the roofing membrane 600 of FIG. 18 where merely protection from the elements is required without a hazard of heavy falling objects from the construction site, decking boards 610 as described above and depicted in FIG. 19 or concrete slabs 620 as described above and depicted in FIG. 20. Such a roofing structure will extend across along the length of the modular access structure to provide overhead protection along its length.

A modular access structure formed from a plurality of the access modules 1 may be disassembled effectively by reversing the above process, unfastening each access module 1 from the adjacent access module 1 by removing the fasteners securing each spigot 500 fastening adjacent access modules 1 from one of the two fastened access modules 1. Each access module 1 may then be configured into the collapsed configuration for subsequent transportation by deforming the lower support structure 300 and upper support structure 400 of each access module 1 to bring the access module 1 into the collapsed configuration shown in FIGS. 6 and 7. To enable the lower and upper support structures 300, 400 to be deformed, each locking pin 440 locking the first and second strut segments 420, 430 to the upper stubs 180, and the first beam and second segments 320, 330 to the lower stubs 190 is removed. Once all locking pins 440 have been removed, the lateral struts 400 are deflected downwardly and the floor beams 310 deflected upwardly, allowing the first and second frames 100, 200 to be drawn toward each other into the collapsed configuration depicted in FIG. 6.

In the collapsed configuration, as discussed above, the corresponding upper stubs 180, 280 of the first and second frames 100, 200 engage, with the distal flange portions 281*b* of each upper stub 280 being received between the flanges 181 of the corresponding upper stub 180 with the corresponding locking pin apertures 184, 284 aligned. Locking pins 440 are then inserted through the locking pin apertures 184, 284 so as to lock the access module 1 in the collapsed configuration. Similarly, in the collapsed configuration, the corresponding lower stubs 190, 290 engage, with the distal flanges 291*b* of each lower stub 290 received between the flanges 191 of the corresponding lower stub 190 with the corresponding locking pin apertures 194, 294 aligned. Again locking pins 440 are extended through the locking pin apertures 194, 294 to further lock the access module 1 in the collapsed configuration. The access module 1 is thus locked into the collapsed configuration with a reduced volume as compared to when in the extended configuration, making the collapsed configuration particularly suitable for transportation.

Figure 17:
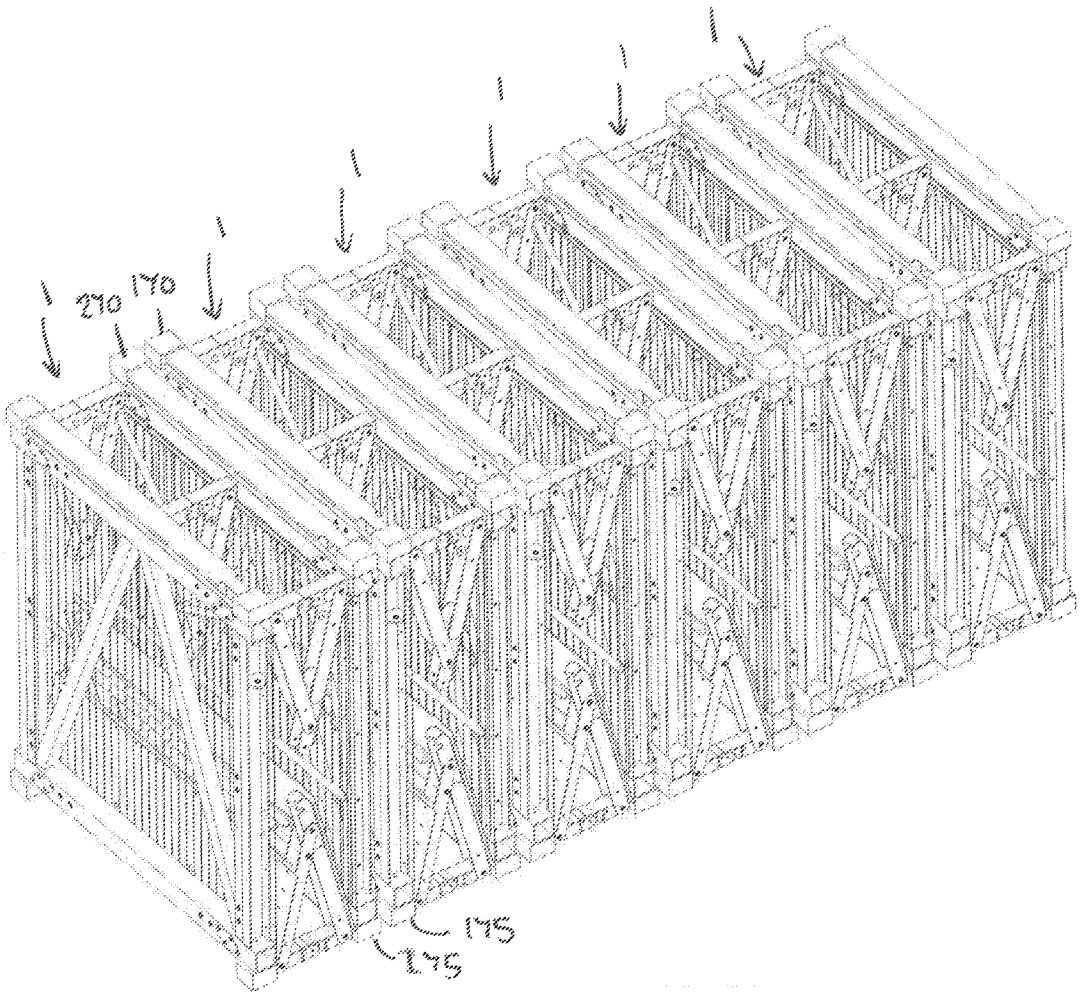
FIG. 17 is an isometric view of an assembly of six access modules of FIG. 1 each in the collapsed configuration.

To further assist in transportation of the access module 1, a plurality of the access modules 1 in the collapsed configuration may be connected side by side, as particularly depicted in FIG. 17. In FIG. 17, six of the access modules 1 are connected side to side by way of standard twist-lock connectors (not depicted) connecting corresponding upper corner blocks 170, 270 and corresponding lower corner blocks 175, 275 of adjacent access modules 1. Each access module 1 is sized, and the corner blocks 170, 270, 175, 275 located, such that when six of the access modules 1 are interconnected side by side to form an access module assembly with each of the access modules 1 in a collapsed configuration, the outermost corner blocks 170, 270, 175, 275 of the access module assembly are spaced to at least substantially match the spacing of corner blocks of an ISO standard cargo container. In the embodiment depicted, the overall length of the assembly of six access modules 1, measured from the outer ends of the outer most corner blocks 170, 270, 175, 275 is 6056 mm, which is substantially equal to the length of a 20 ft ISO standard cargo container having corner fittings spaced according to ISO 1161:2016 (equivalent to AS/NS3711). The overall width of the access module assembly, measured from the outermost surfaces of the corner blocks 170, 270, 175, 275 is 2438 mm, which is again substantially equal to the width of a 20 ft ISO standard cargo container.

The access module assembly can thus be handled and transported in the same manner as a 20 ft ISO standard cargo container, including being able to be lifted by standard cargo containing lifting frames and equipment.

Figure 21:
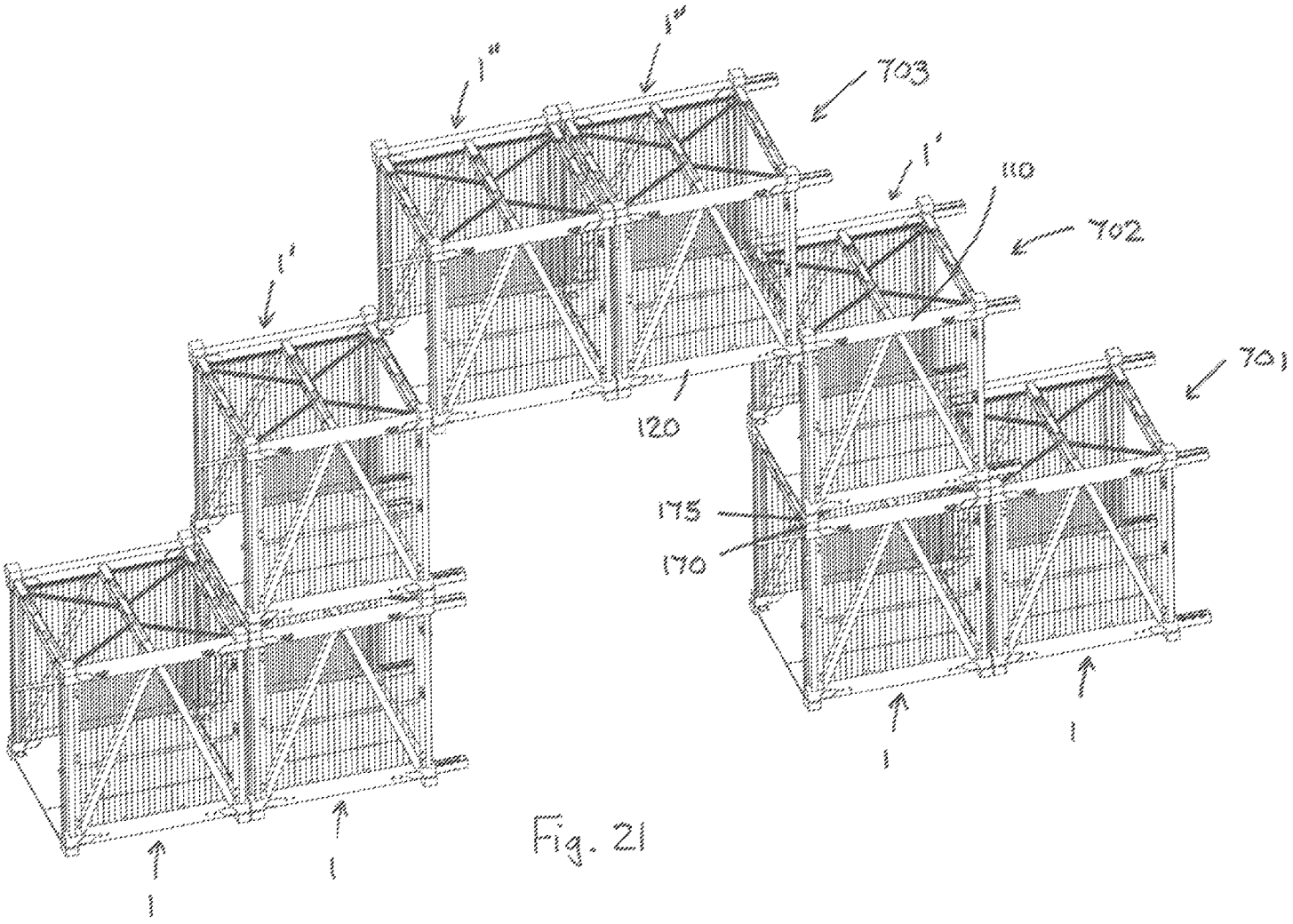
FIG. 21 is an isometric view of a modular overhead protection structure comprising a plurality of access modules of FIG. 1.
Figure 22:
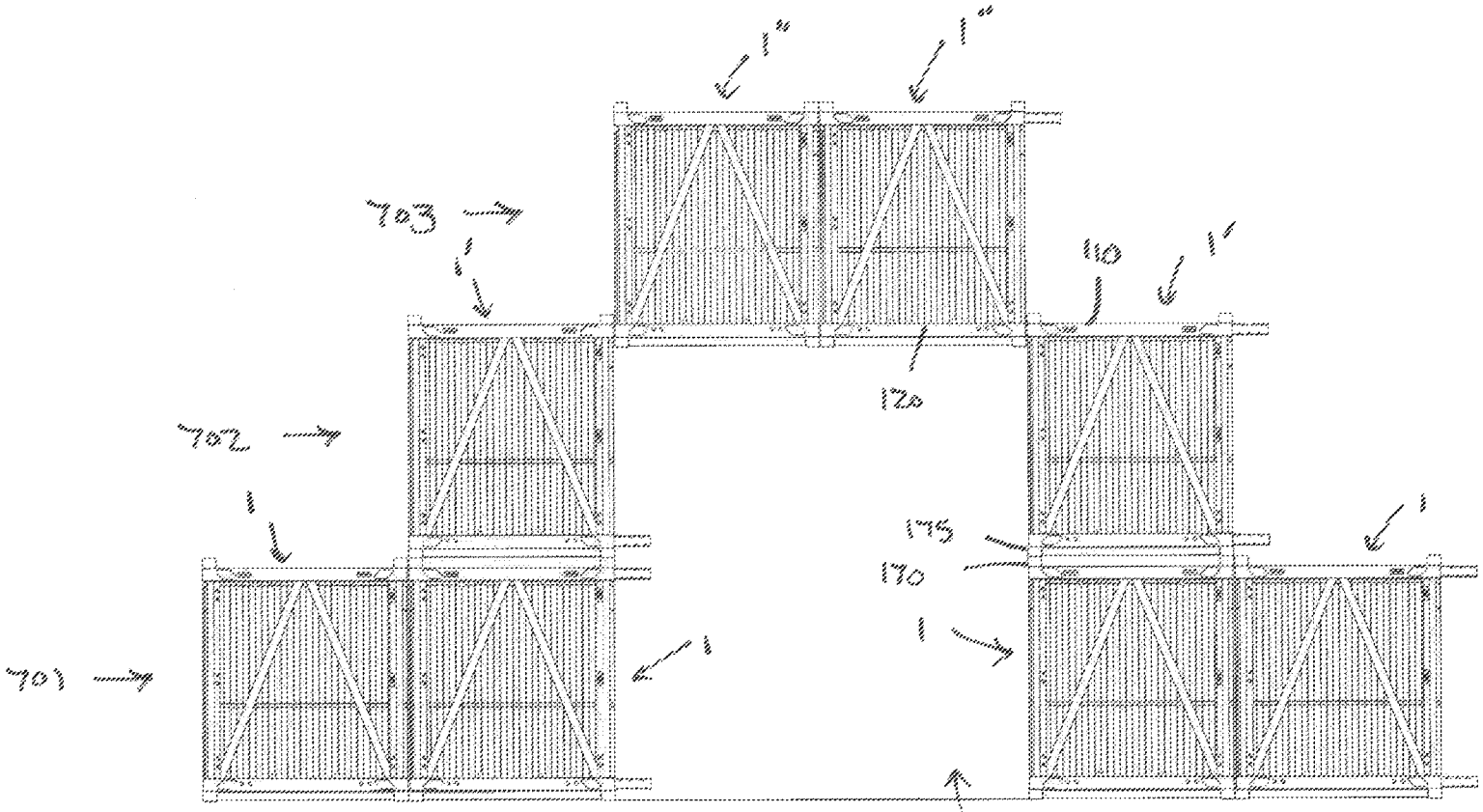
FIG. 22 is a front elevation view of the modular overhead protection structure of FIG. 21.

FIGS. 21 and 22 depict a modular access structure formed from a plurality of the access modules 1 and specifically forming a modular overhead protection structure that is configured to provide an opening 700 for access through the modular overhead protection structure to an adjacent construction site. In the configuration depicted, several access modules 1 are fastened end to end in the manner described above on either side of the opening 700 to form a first level 701 of the modular access structure. A second level 702 of the modular access structure is provided by mounting access modules 1' on top of the access modules 1 of the first level 701 adjacent the opening 760. The access modules 1' are each stacked directly on top of the underlying access module 1 with the access modules 1, 1' fastened to each other by way of stand and corner block connectors interconnecting the upper blocks 170, 270 of the lower access module 1 with the lower corner blocks 175, 275 of the access module 1'. The opening 700 may thus be formed of the desired height to allow vehicles and the like to pass through the modular access structure as required by stacking further access modules 1 on top of each other. Continuous overhead protection across the opening 700 is maintained by way of a third level 703 of access modules 1" that are fastened end to end to span across the opening 700 and fastened to the access modules 1' of the second level 702. In the arrangement depicted, the lower chords 120, 220 of the upper most access modules 1" are fastened end to end to the upper chords 110, 210 of the access modules 1' by way of spigots 500 in the same manner as discussed above. Alternatively, the uppermost access modules 1" could be supported on top of the access modules 1' by way of the lower corner blocks 175, 275 of the upper most access modules 1" being supported on and fastened to the top corner blocks 170, 270 of the access modules 1'.

Figure 23:
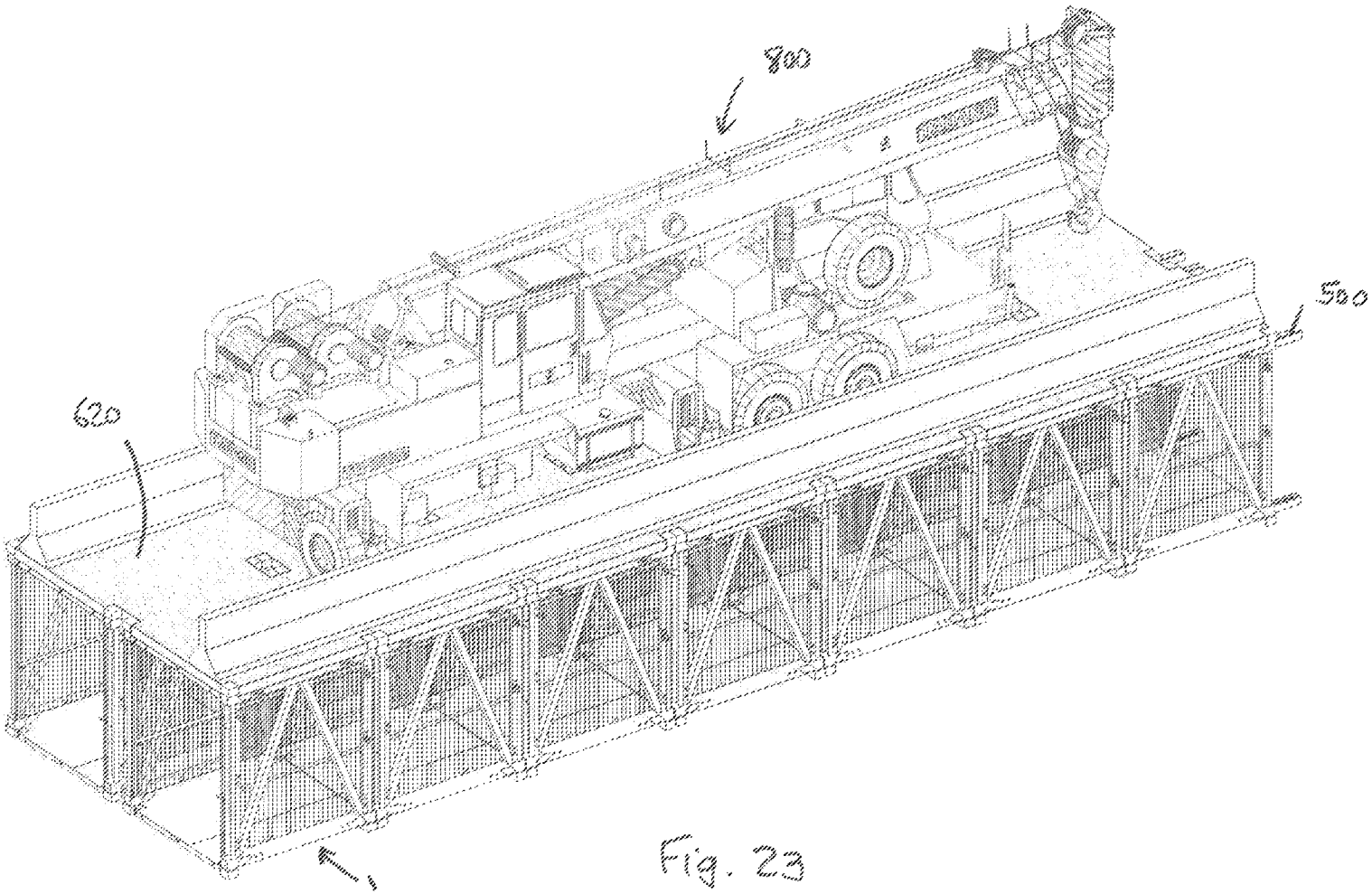
FIG. 23 is an isometric view of a modular access structure comprising two adjacent rows of access modules of FIG. 1 with a roadway deck extending along the top of the access modules.

Referring to FIG. 23, a modular access structure is depicted formed of two adjacent rows of access modules 1. The access modules 1 of each row are fastened end to end by way of spigots 500 in the manner described above, whilst adjacent access modules 1 of the two rows may be fastened side to side by way of corner block connectors secured to adjacent corner blocks. A roofing structure formed of concrete slabs 620 extends longitudinally along the modular access structure, and laterally across both rows of access modules 1 so as to form a roadway deck for support and movement of equipment to be utilised on a construction site, such as a crane 800 as shown.

A person skilled in the art will appreciate various modifications and alternatives to individual aspects of the access module and modular access structure described, along with alternate uses of the access module and modular access structure.

The invention claimed is:

1. An access module for a modular access structure, said access module comprising:

a longitudinally and vertically extending first frame having a longitudinally extending upper chord and a longitudinally extending lower chord;

a longitudinally and vertically extending second frame having a longitudinally extending upper chord and a longitudinally extending lower chord, said second frame laterally opposing said first frame;

a deformable lower support structure laterally extending between said first and second frames, said lower support structure including a deck spanning a longitudinal length of said access module; and a deformable upper support structure laterally extending between said first and second frames, said upper support structure being spaced above said deck to define an access passage extending along a length of said access module between said deck, said upper support structure and said first and second frames; and a plurality of connectors, each of said connectors being adapted to fasten one of said chords of one of said frames end to end to a corresponding chord of a corresponding frame of a second access module, wherein:

said access module is configurable by deformation of said lower and upper support structures between an extended configuration in which said first and second frames are spaced apart a first distance and said deck is generally horizontal and a collapsed configuration in which a distance between said first and second frames is less than said first distance, said access module is adapted to be fastened end to end to a second access module to form a modular access structure with an access passage extending along a length of the modular access structure, each of said lower chords being adapted to be fastened end to end to a corresponding lower chord of the second access module to form a single load bearing elongate lower chord assembly, said upper and lower chords of each of said first and second frames each comprises a hollow structural section and each said connector comprises a spigot mounted in the hollow of the respective said chord, and each said spigot is displaceable between a protruding configuration in which said spigot protrudes from an end of the respective said chord and a retracted configuration in which said spigot is retained wholly within said chord.

2. The access module of claim 1 further comprising a roofing structure extending between said first and second frames adjacent said upper support structure.

3. The access module of claim 1, wherein said first and second frames each further comprise a pair of corner blocks mounted towards opposing longitudinal ends of said upper chord, said corner blocks being configured to be engaged by twist-locks for lifting said access module.

4. The access module of claim 3, wherein said corner blocks are located and configured to allow multiple said access modules to be interconnected side to side.

5. The access module of claim 4, wherein said access module is sized, and said corner blocks located, such that a plurality of said access modules may be interconnected side to side to form an access module assembly with each of said access modules in the collapsed configuration such that the outer most corner blocks of the access module assembly are spaced to at least substantially match the spacing of corner blocks of an ISO standard cargo container.

6. The access module of claim 1 wherein:

said lower support structure comprises a plurality of longitudinally spaced and laterally extending articulated floor beams;

opposing ends of each said floor beam are pivotally attached to said first frame and said second frame respectively;

each said floor beam comprises a first beam segment and a second beam segment pivotally attached to said first beam segment;

wherein said deck is mounted on said floor beams;

further wherein, for each said floor beam:

when said access module is in said extended configuration, said first and second beam segments extend substantially collinearly; and when said access module is in said collapsed configuration, said first and second beam segments are mutually angularly inclined.

7. The access module of claim 6, wherein said deck comprises a first deck section mounted on said first beam segment of each said floor beam and a second deck section mounted on said second beam segment of each of said floor beams;

wherein, when said access module is in said extended configuration, said first and second deck sections substantially abut.

8. The access module of claim 6, wherein each said floor beam is configured to be fixed when said access module is in said extended configuration by way of a beam locking pin extending laterally through said first and second beam segments.

9. The access module of claim 6 wherein:

said upper support structure comprises a plurality of longitudinally spaced and laterally extending lateral struts;

opposing ends of each said lateral strut are pivotally attached to said first frame and said second frame respectively;

each said lateral strut comprises a first strut segment and a second strut segment pivotally attached to said first strut segment;

further wherein, for each said lateral strut:

when said access module is in said extended configuration, said first and second strut segments extend substantially collinearly; and when said access module is in said collapsed configuration, said first and second strut segments are mutually angularly inclined.

10. The access module of claim 9, wherein each said lateral strut is configured to be fixed when said access module is in said extended configuration by way of a strut locking pin extending laterally through said first and second strut segments.

11. The access module of claim 9, wherein each of said first and second frames further comprises:

a plurality of laterally projecting upper stubs mounted to or adjacent said upper chord and a plurality of laterally projecting lower stubs mounted to or adjacent said lower chord, each said upper stub of said first frame opposing a corresponding upper stub of said second frame and each said lower stub of said first frame opposing a corresponding lower stub of said second frame;

further wherein:

each of said lateral struts is pivotally attached to corresponding upper stubs of said first and second frames; and each of said floor beams is pivotally attached to corresponding lower stubs of said first and second frames.

12. The access module of claim 11, wherein when said access module is in the collapsed configuration, corresponding upper stubs of said first and second frames engage and corresponding lower stubs of said first and second frames engage; and said corresponding upper stubs and said corresponding lower stubs are configured to lock when engaged to lock said access module in said collapsed configuration.

13. A modular access structure comprising a plurality of access modules fastened together, each of said access modules comprising:

a longitudinally and vertically extending first frame having a longitudinally extending upper chord and a longitudinally extending lower chord;

a longitudinally and vertically extending second frame having a longitudinally extending upper chord and a longitudinally extending lower chord, said second frame laterally opposing said first frame;

a deformable lower support structure laterally extending between said first and second frames, said lower support structure including a deck spanning a longitudinal length of said access module; and a deformable upper support structure laterally extending between said first and second frames, said upper support structure being spaced above said deck to define an access passage extending along a length of said access module between said deck, said upper support structure and said first and second frames, wherein:

said access module is configurable by deformation of said lower and upper support structures between an extended configuration in which said first and second frames are spaced apart a first distance and said deck is generally horizontal and a collapsed configuration in which a distance between said first and second frames is less than said first distance, said access module is fastened end to end to at least one other access module to form said modular access structure with an access passage extending along a length of said modular access structure, each of said lower chords being adapted to be fastened end to end to a corresponding lower chord of said other access module to form a single load bearing elongate lower chord assembly, said first and second frames each further comprise a pair of corner blocks mounted towards opposing longitudinal ends of said upper chord, said corner blocks being configured to be engaged by twist-locks for lifting said access module, said corner blocks are located and configured to allow multiple said access modules to be interconnected side to side, and said access module is sized, and said corner blocks located, such that a plurality of said access modules may be interconnected side to side to form said access module assembly with each of said access modules in said collapsed configuration such that the outer most corner blocks of said access module assembly are spaced to at least substantially match the spacing of corner blocks of an ISO standard cargo container.

14. The modular access structure of claim 13 wherein said modular access structure is a modular bridge structure.

* * * * *